US011771150B2

(12) United States Patent
Correia Neves

(10) Patent No.: US 11,771,150 B2
(45) **Date of Patent: *Oct. 3, 2023**

(54) WEARABLE AIRFOIL

(71) Applicant: Joao M P Correia Neves, Houston, TX (US)

(72) Inventor: Joao M P Correia Neves, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/220,624

(22) Filed: Apr. 1, 2021

(65) Prior Publication Data

US 2021/0227903 A1 Jul. 29, 2021

Related U.S. Application Data

(63) Continuation of application No. 17/128,057, filed on Dec. 19, 2020, now Pat. No. 11,160,318, and a (Continued)

(51) Int. Cl.
*A41D 13/00* (2006.01)
*A41D 1/084* (2018.01)
(Continued)

(52) U.S. Cl.
CPC ..... *A41D 13/0015* (2013.01); *A41D 1/084* (2013.01); *A41D 27/10* (2013.01);
(Continued)

(58) Field of Classification Search
CPC .... A41D 13/0015; A41D 31/18; A41D 1/084; A41D 27/20; A41D 2400/24; A41D 2600/10
See application file for complete search history.

(56) References Cited

U.S. PATENT DOCUMENTS 766,613 A * 8/1904 Greene ..... A41D 3/08 D2/741
1,110,710 A * 9/1914 Ogilvie ..... B64D 10/00 244/143
(Continued)

FOREIGN PATENT DOCUMENTS

GB 2501892 A 11/2013
GB 2502514 A 12/2013
(Continued)

OTHER PUBLICATIONS

PCT/ISA/237, Written Opinion of the International Searching Authority, PCT/US2020/057258, International Filing Date Oct. 25, 2020.
(Continued)

*Primary Examiner* — Richale L Quinn
(74) *Attorney, Agent, or Firm* — Gunn. Lee & Cave P.C.

(57) ABSTRACT

An wearable airfoil garment having one or more stretchable suspension lines disposed on the garment between one or more of the following combinations of proximate locations: the wrist and the shoulder, the back of the ankle and the back of the leg (upper portion of the adductor longus), and along a location on the back of the arm and a location on the torso. For each stretchable suspension line, a flexible and stretchable cloth material is attached to and forming a portion of the garment. The flexible and stretchable cloth material is attached to the stretchable suspension line, forming a draped and collapsible airfoil. The one or more stretchable suspension lines forms a cusp shape, whereby a trailing edge is formed.

2 Claims, 12 Drawing Sheets

Related U.S. Application Data continuation of application No. PCT/US2020/057258, filed on Oct. 25, 2020.

(60) Provisional application No. 62/950,942, filed on Dec. 20, 2019.

(51) Int. Cl.
*A41D 31/18* (2019.01)
*A41D 27/10* (2006.01)

(52) U.S. Cl.
CPC ..... *A41D 31/18* (2019.02); *A41D 2400/24* (2013.01); *A41D 2600/104* (2013.01)

(56) References Cited

U.S. PATENT DOCUMENTS 1,120,165 A * 12/1914 Slawinska ..... A41D 3/08 244/143
1,178,165 A * 4/1916 Lupton, Jr. ..... B64C 33/00 280/810
1,257,049 A * 2/1918 Tataryn ..... B64D 17/00 244/142
2,213,754 A * 9/1940 Hansthirring ..... A41D 13/00 D2/741
2,334,498 A * 11/1943 Merkent ..... A41D 27/10 D2/858
4,077,064 A * 3/1978 Maidon ..... A41D 13/02 2/456
4,220,299 A * 9/1980 Motter ..... B64D 17/00 2/84
4,531,763 A * 7/1985 Toland ..... A63C 11/00 280/810
4,884,768 A * 12/1989 Ansley ..... B64D 10/00 280/810
D310,596 S * 9/1990 Burger ..... D2/824
D320,475 S * 10/1991 Jeter, Jr. ..... D29/100
5,176,600 A * 1/1993 Wilkinson ..... A63B 21/4021 482/122
D351,493 S * 10/1994 DeCinque ..... D2/741
5,371,903 A * 12/1994 Lew ..... A41D 13/00 2/88
5,406,647 A * 4/1995 Lew ..... A41D 13/00 2/88
5,412,813 A * 5/1995 Hosley ..... A41D 13/00 2/243.1
5,451,060 A * 9/1995 Dalbo ..... A63B 69/0059 473/215
5,490,846 A 2/1996 Ellis et al.
5,522,810 A 6/1996 Allen, Jr. et al.
5,781,930 A * 7/1998 Boshoff ..... A41D 13/00 2/93
5,819,315 A 10/1998 Ruffa
5,837,352 A 11/1998 English et al.
5,843,057 A 12/1998 McCormack
5,873,131 A * 2/1999 Sabin ..... A41D 13/00 2/88
5,882,769 A 3/1999 McCormack et al.
5,887,280 A * 3/1999 Waring ..... A41D 13/0015 2/10
5,956,764 A * 9/1999 Sabin ..... A41D 13/00 2/69
6,065,416 A * 5/2000 Araeen ..... B63B 32/50 440/37
6,075,179 A 6/2000 McCormack et al.
6,497,696 B1 12/2002 Freiburger et al.
6,500,162 B1 12/2002 Freiburger et al.
6,503,239 B1 1/2003 Bruemmer-Prestley et al.
7,117,538 B2 * 10/2006 Bosne ..... A41D 13/0015 2/93
7,222,371 B2 * 5/2007 Houghton ..... A41D 23/00 2/84
D607,183 S * 1/2010 Stumpfl ..... D2/858
8,695,117 B1 * 4/2014 Machuca ..... A41D 31/18 2/69
9,072,324 B2 * 7/2015 Zamponi ..... A41D 13/0543
9,578,904 B2 * 2/2017 Bybee ..... A41D 1/04
9,974,346 B2 * 5/2018 Beneyto-Ferre ..... A41D 31/18
10,045,575 B2 * 8/2018 Whyte ..... A41D 27/08
10,118,063 B2 * 11/2018 DeYoung ..... A63B 21/0552
10,285,463 B2 * 5/2019 Parkinson ..... A63B 21/4011
10,420,431 B1 * 9/2019 Speciale ..... A41D 31/02
10,477,906 B2 * 11/2019 Mangnall-Schwarz ..... A41D 27/10
10,548,358 B2 * 2/2020 Roberts ..... A41D 27/24
11,154,100 B2 * 10/2021 Molyneux ..... A41D 13/012
11,160,318 B2 * 11/2021 Neves ..... A41D 13/0015
2004/0221362 A1 * 11/2004 Bosne ..... A41D 13/0015 2/93
2010/0144490 A1 * 6/2010 Purdy ..... A63B 21/4013 2/69
2015/0366281 A1 12/2015 Miller et al.
2016/0242474 A1 * 8/2016 Baschak ..... A41D 31/102
2017/0197107 A1 * 7/2017 Parkinson ..... B64D 19/00
2018/0084845 A1 * 3/2018 Cumiskey ..... A41D 31/02
2020/0039649 A1 * 2/2020 Gerdes ..... B64D 10/00

FOREIGN PATENT DOCUMENTS

WO 93/18673 A1 9/1993
WO 94/19975 A1 9/1994

OTHER PUBLICATIONS

PCT/ISA/210, International Search Report, PCT/US2020/057258, International Filing Date Oct. 25, 2020.
Supplementary European Search Report, European Patent Office, Application No. 20 90 2068, dated Apr. 2, 2022.

* cited by examiner

WEARABLE AIRFOIL

CROSS REFERENCE TO RELATED APPLICATIONS

This application claims the benefit of U.S. Non-Provisional application Ser. No. 17/128,057 of filing date Dec. 19, 2020, which claims the benefit of U.S. Provisional Application No. 62/950,942 of filing date Dec. 20, 2019. This application claims the benefit of International Application No. PCT/US20/57258, filed Oct. 25, 2020, which claims the benefit of U.S. Provisional Application No. 62/950,942 of filing date Dec. 20, 2019.

TECHNICAL FIELD

Disclosed herein is a wearable airfoil for reducing cyclist air drag.

BACKGROUND OF THE INVENTION

Cyclists have attempted to improve cycling performance with rigid slipstream constructions, typically attached to the bicycle. These efforts typically focus on improving the aerodynamics of the bicycle frame and wheels or by placing Aerodynamic fairings around the cyclist. As important as these improvements have been, they are often cumbersome and do not practically address the primary sources of Aerodynamic Drag on a cyclist, those on the human body.

The Aerodynamic Drag Forces are determined by the cyclist's anatomy and posture and motion during the pedal cycle with respect to the free air stream. The frontal area presented by the cyclist in the direction of motion as well as the body cross section are parameters of key significance to the Aerodynamic Drag. Therefore, it is easy to see that the Aerodynamic Drag generated by the cyclist is many times larger than that generated by the bicycle frame and wheels. The problem is also more challenging to analyze because of the complexities of the geometry of the human body anatomy in the various cycling postures during the pedal cycle.

BRIEF SUMMARY OF THE INVENTION

BRIEF DESCRIPTION OF THE SEVERAL DRAWINGS

Figure 11:
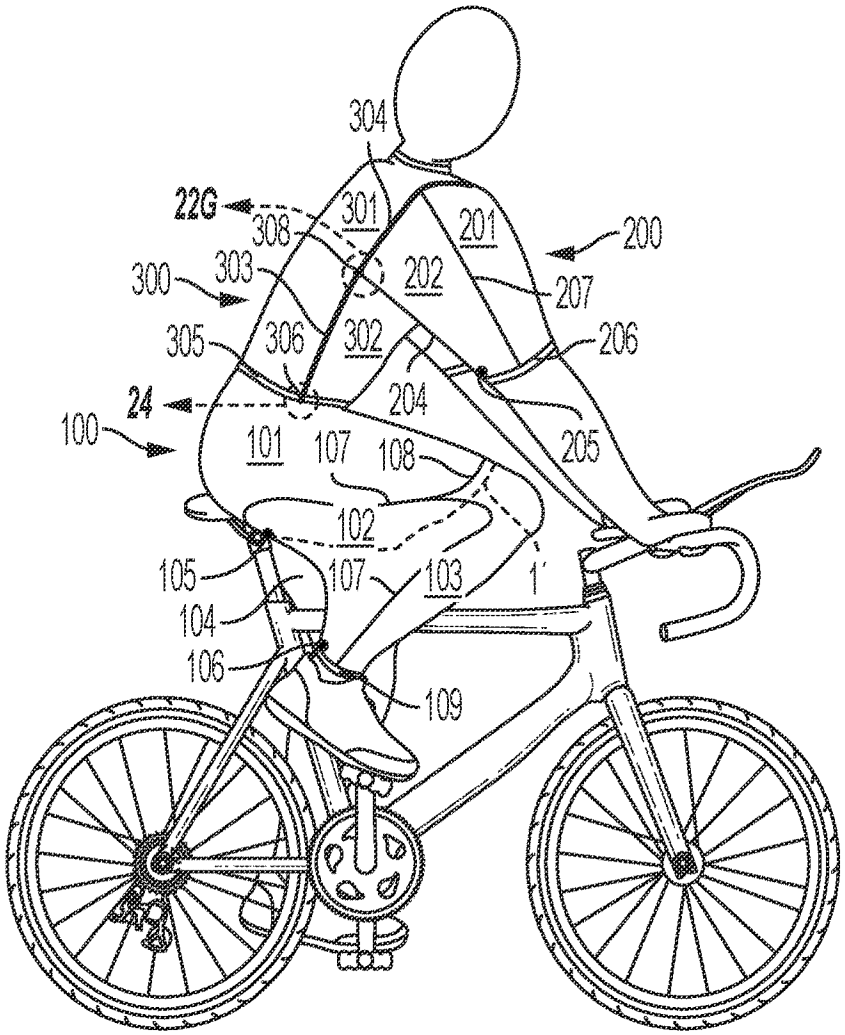
Figure 10:
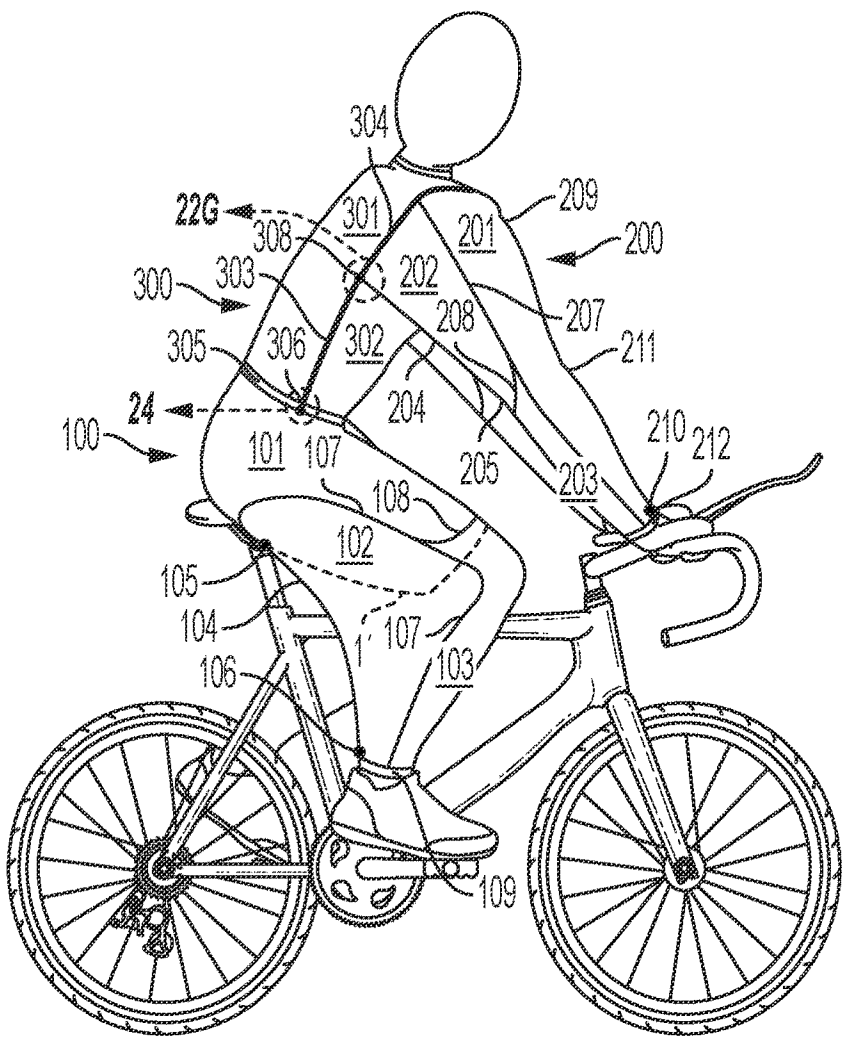
Figure 13:
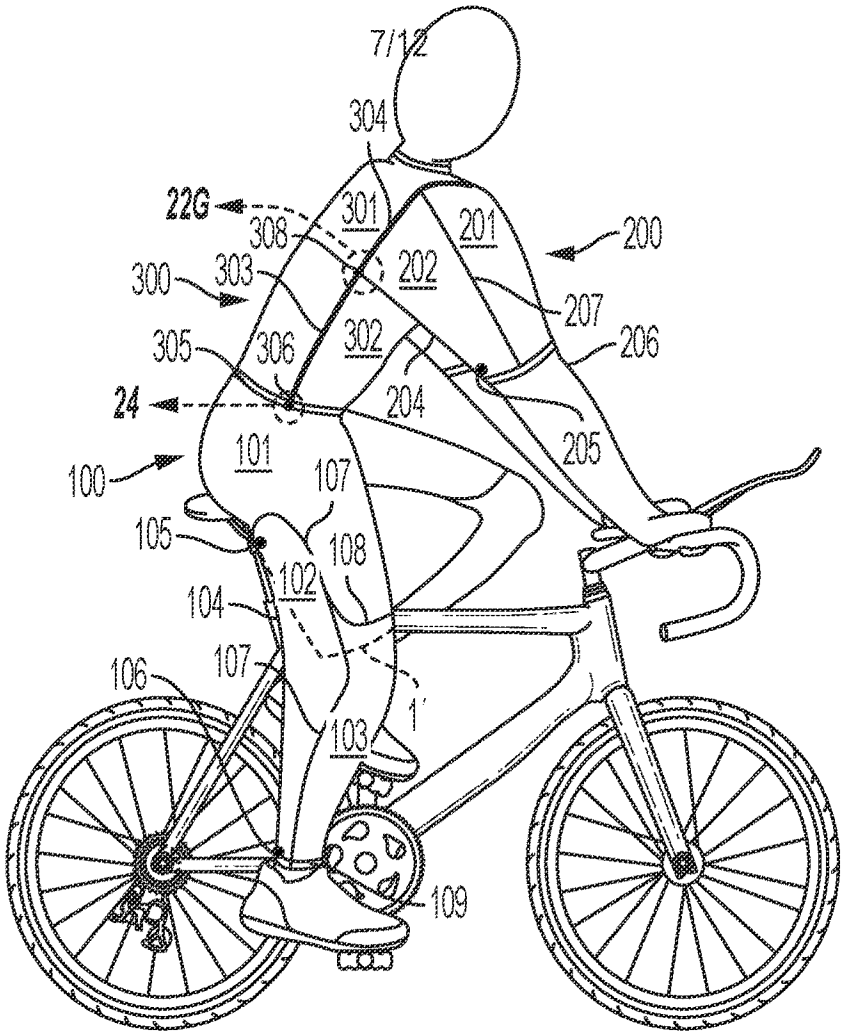
Figure 12:
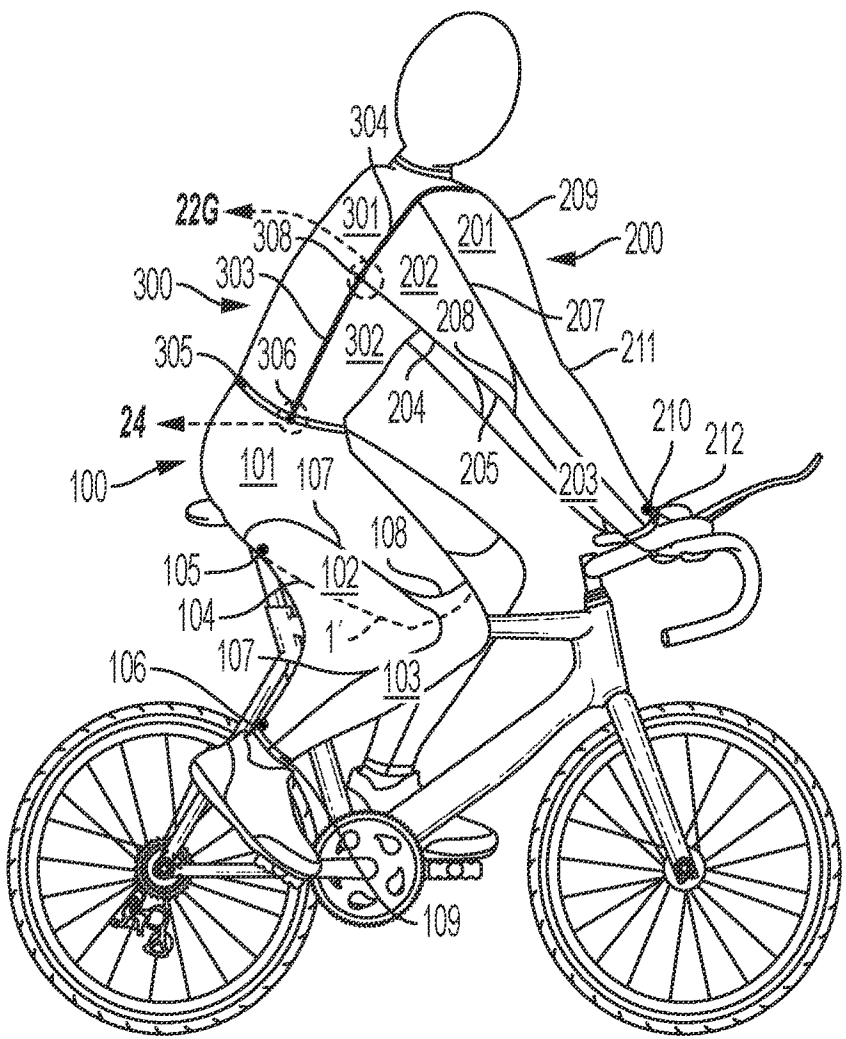
Figure 14A:
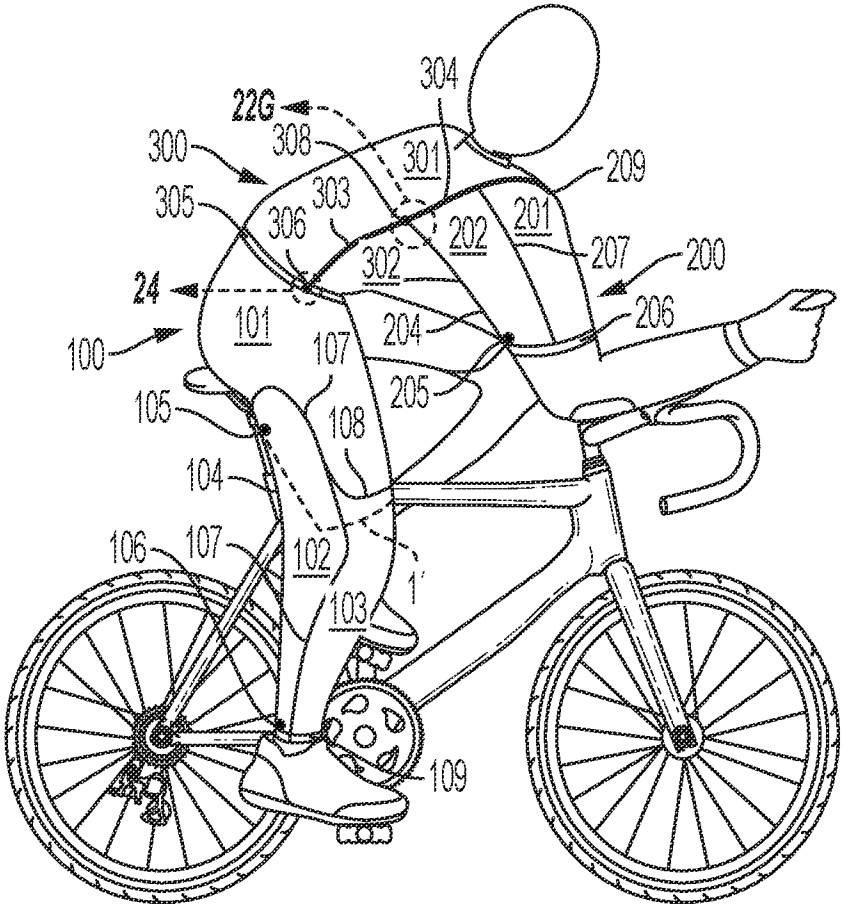
Figure 14:
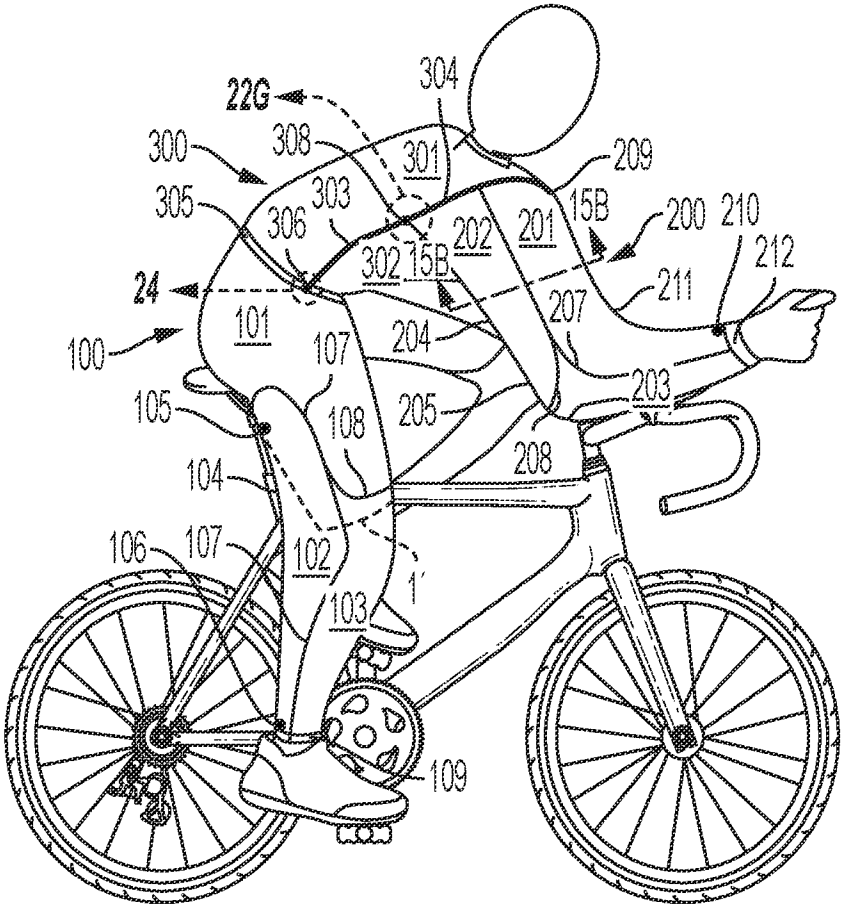
Figure 15A:
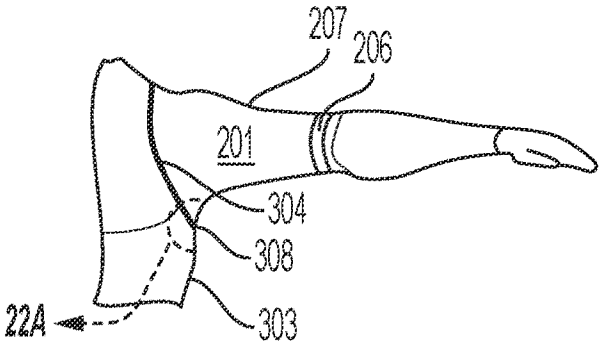
Figure 15B:
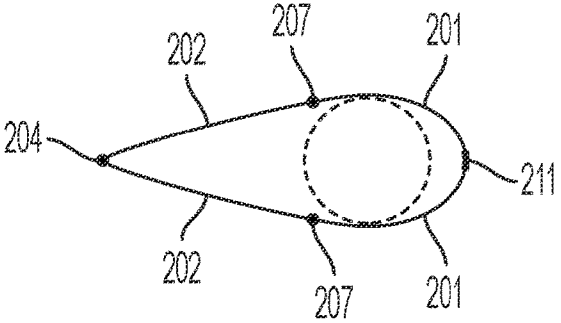
Figure 15:
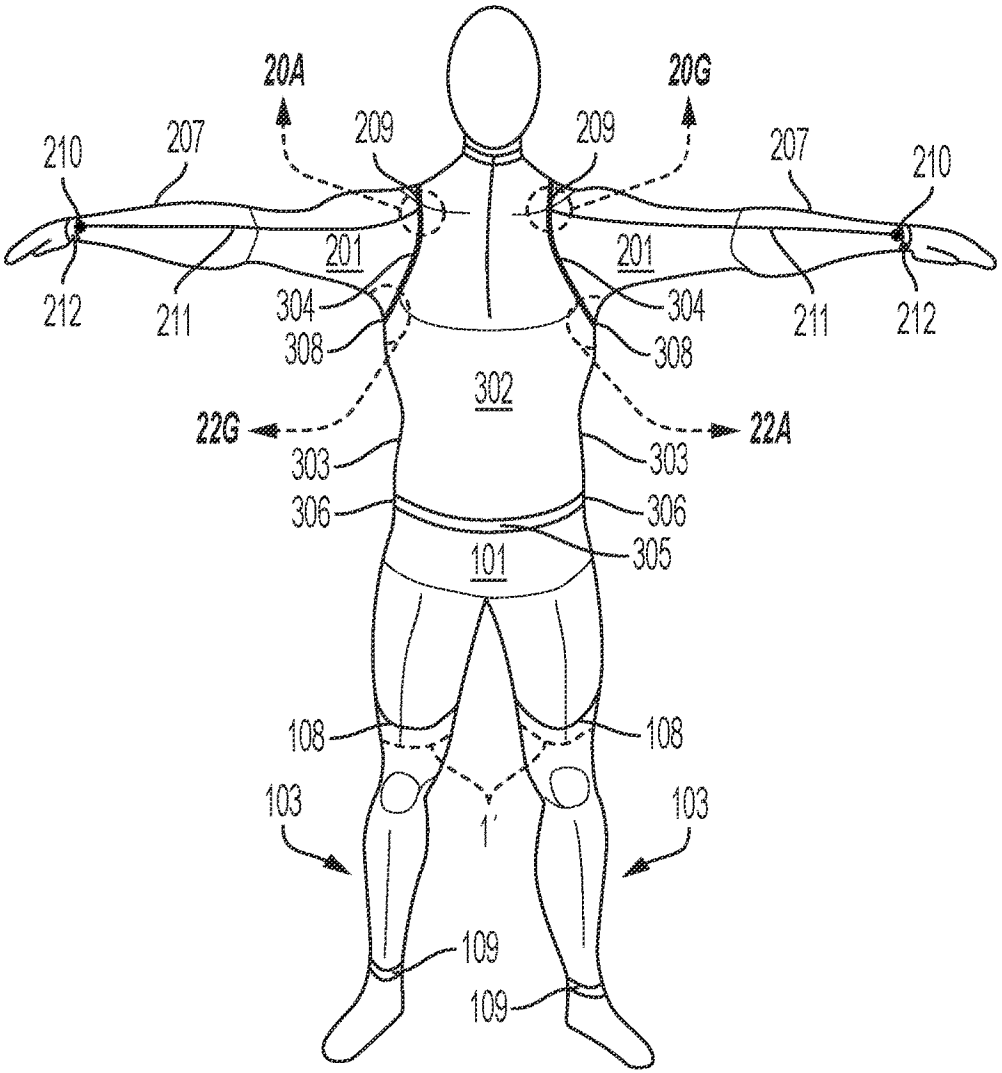

FIG. 10 is a right side view of a biker on a bicycle traversing from left to right, showing placement of an example of the leg airfoil and placement of an example of the upper body torso airfoil and placement of an example of the upper body arm airfoil, with the right pedal in a zero degree (0°) position, with stretched arms to the handle bars in a first posture position, with a long sleeve jersey;

FIG. 11 is a right side view of a biker on a bicycle traversing from left to right, showing placement of an example of the leg airfoil and placement of an example of the upper body torso airfoil and placement of an example of the upper body arm airfoil, with the right pedal in a ninety degree (90°) position, with stretched arms to the handle bars in the first posture position, with a short sleeve jersey;

FIG. 12 is a right side view of a biker on a bicycle traversing from left to right, showing placement of an example of the leg airfoil and placement of an example of the upper body torso airfoil and placement of an example of the upper body arm airfoil, with the right pedal in a one hundred eighty degree (180°) position, with stretched arms to the handle bars in the first posture position, with a long sleeve jersey;

FIG. 13 is a right side view of a biker on a bicycle traversing from left to right, showing placement of an example of the leg airfoil and placement of an example of the upper body torso airfoil and placement of an example of the upper body arm airfoil, with the right pedal in a two hundred seventy degree (270°) position, with stretched arms to the handle bars in the first posture position, with a short sleeve jersey;

FIG. 14 is a right side view of a biker on a bicycle traversing from left to right, showing placement of an example of the leg airfoil and placement of an example of the upper body torso airfoil and placement of an example of the upper body arm airfoil, with the right pedal in the two hundred seventy degree (270°) position, with bent arms and elbows resting on aero bars in a second posture position, with a long sleeve jersey;

FIG. 14A is a right side view of a biker on a bicycle traversing from left to right, showing placement of an example of the leg airfoil and placement of an example of the upper body torso airfoil, with the right pedal in the two hundred seventy degree (270°) position, with arms in a second posture position, with a short sleeve jersey;

FIG. 15 is a 3-D perspective frontal view of a representation of a human body with arms extended horizontally, showing positioning and arrangement of frontal portions of an example of the leg and upper body, torso and arm, airfoils, with a long sleeve jersey;

FIG. 15A is a partial 3-D perspective frontal view showing placement of an example of the upper body torso airfoil only on a horizontally extended arm, with a short sleeve jersey, without the arm airfoil;

FIG. 15B is a cross-section view of the arm portion of FIG. 14, showing positioning and arrangement of surfaces 201 and 202, airfoil cusped trailing edge elastic band or line 204, seam line 207, and elastic band 211.

Figure 16A:
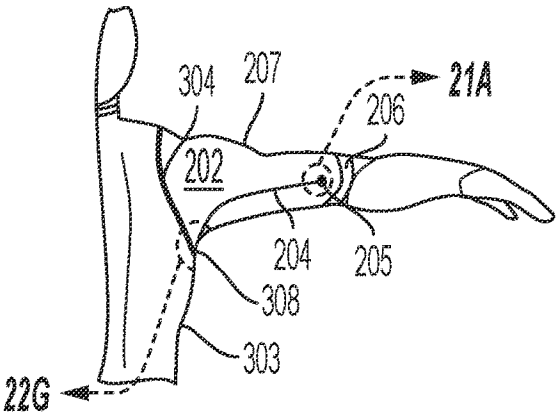
Figure 16:
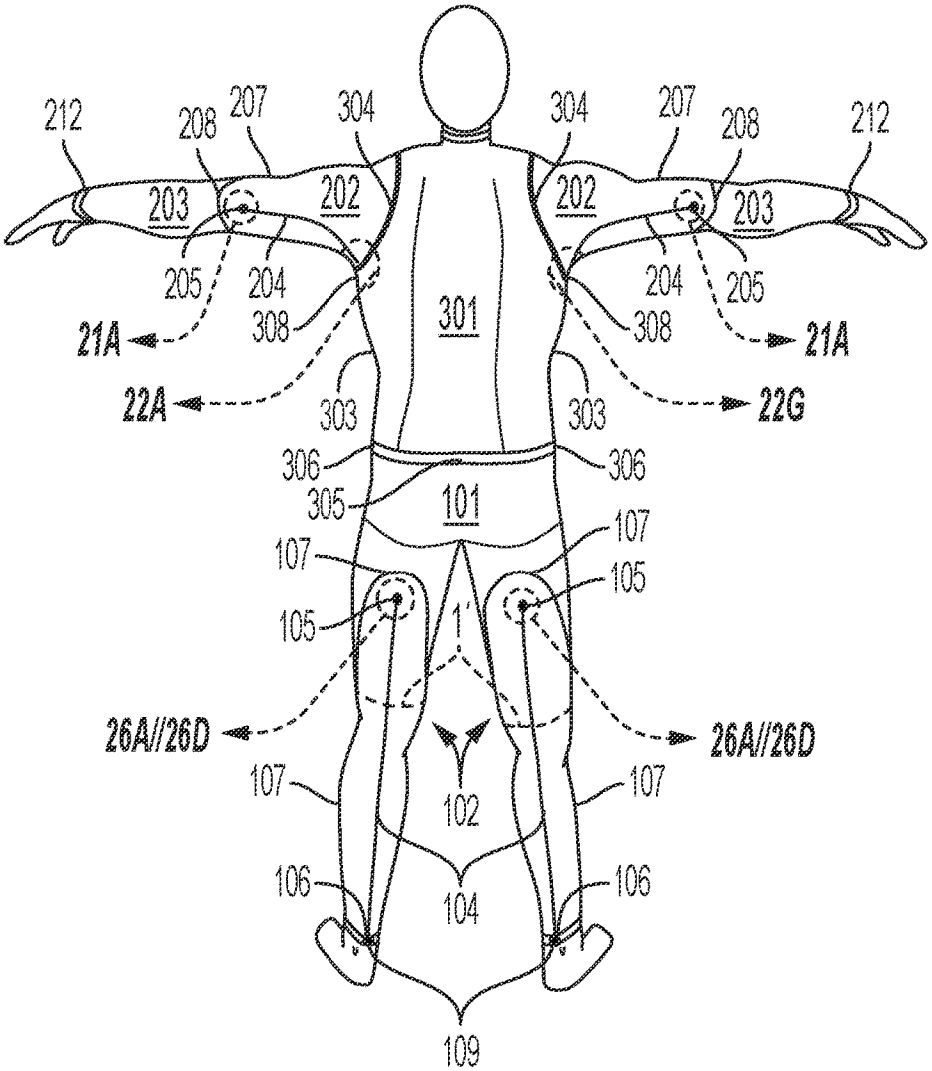
Figure 17A:
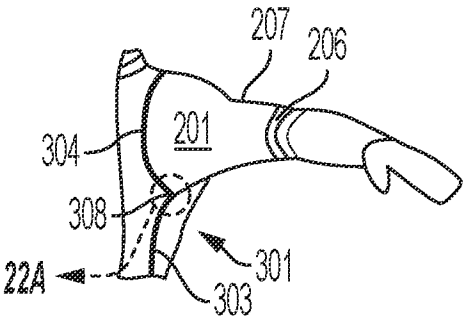
Figure 17:
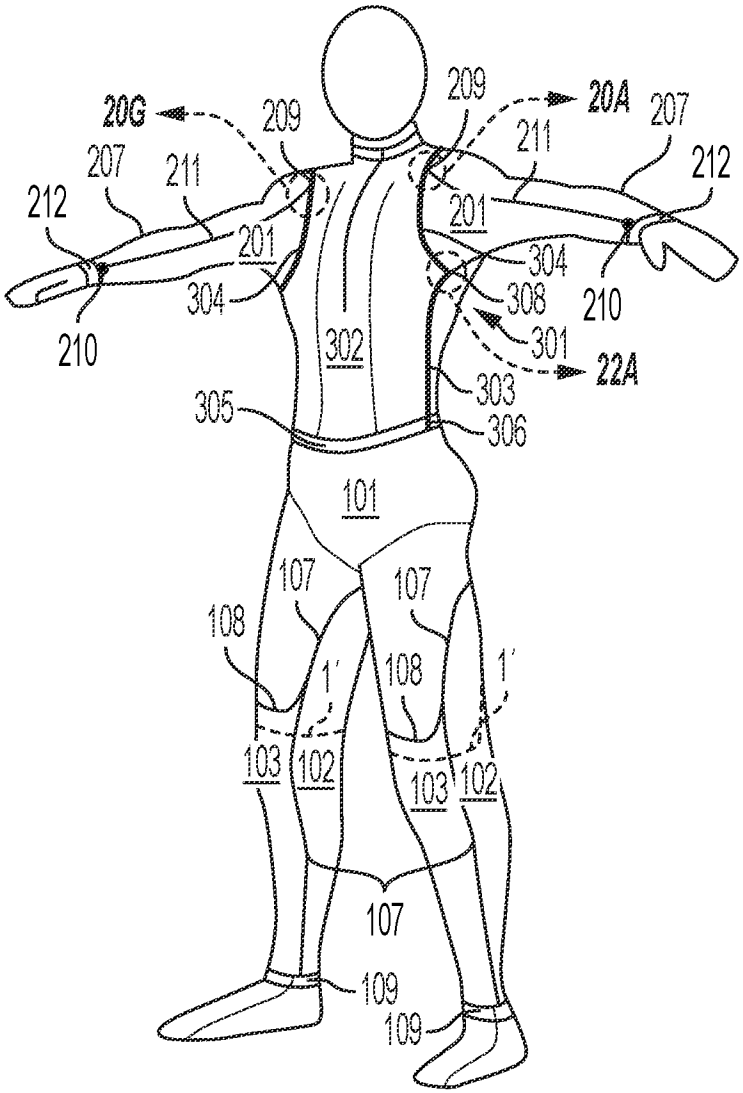
Figure 18A:
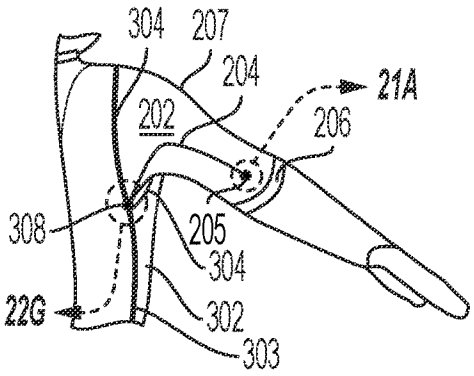
Figure 18:
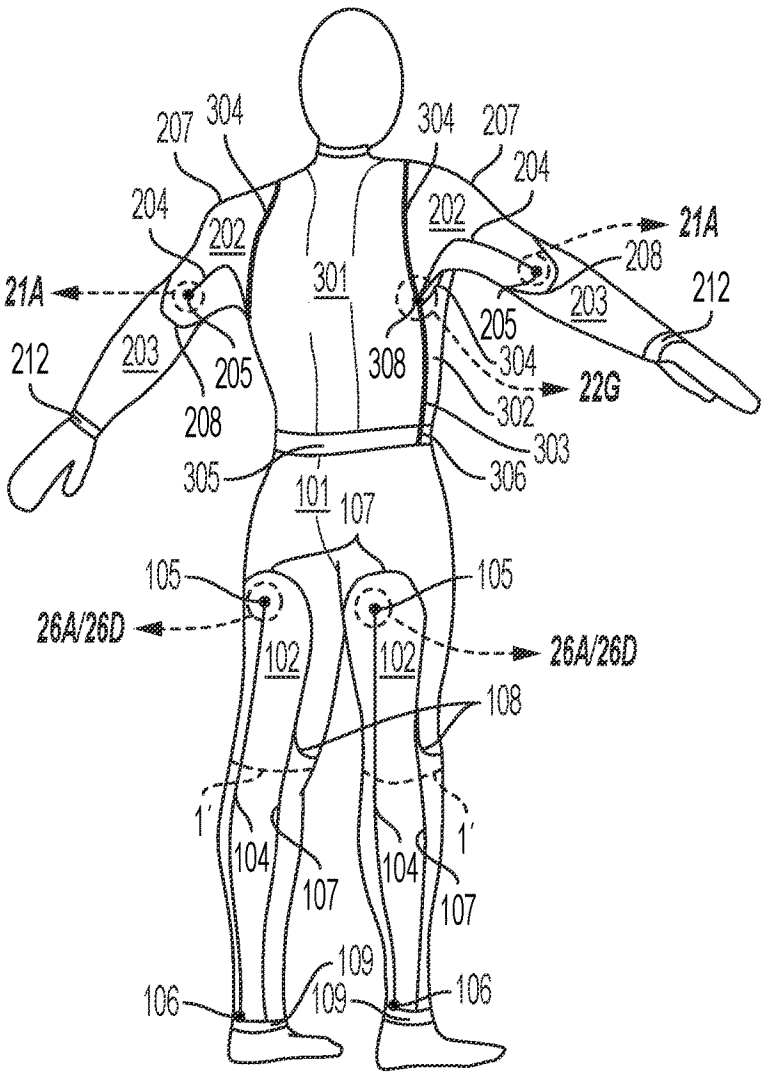

FIG. 16 is a 3-D perspective rear view of a representation of a human body with arms extended horizontally, showing positioning and arrangement of the rear portions of an example of the leg and upper body, torso and arm, airfoils, with a long sleeve jersey;

FIG. 16A is a partial 3-D perspective rear view showing placement of an example of the upper body torso airfoil only on a horizontally extended arm, with a short sleeve jersey, without the arm airfoil;

FIG. 17 is a 3-D perspective frontal left side view of a representation of a human body with arms extended horizontally, showing positioning and arrangement of frontal-side portions of an example of the leg and upper body, torso and arm, airfoils, with a long sleeve jersey;

FIG. 17A is a 3-D perspective frontal left side view showing placement of an example of the upper body torso airfoil only, with arms extended sideways on a short sleeve jersey, without the arm airfoil;

FIG. 18 is a 3-D perspective rear right side view of a representation of a human body with arms extended sideways, showing positioning and arrangement of rear-side portions of an example of the leg and upper body, torso and arm, airfoils, with a long sleeve jersey; and FIG. 18A is a 3-D perspective rear right side view showing placement of an example of the upper body torso airfoil only, with arms extended sideways on a short sleeve jersey, without the arm airfoil.

DETAILED DESCRIPTION OF THE INVENTION

Disclosed herein is a wearable airfoil for reducing cyclist aerodynamic drag.

In one example, a garment is elastically tethered between two or more anchor locations on the garment that are positioned and arranged to form a transient airfoil surface on the garment. The airfoil changes in response to movement of the body of a person wearing the garment. The various airfoil (Torso, Arm & Leg) shapes and cross-sections change in response to movement of the body of a person wearing the garment through the pedal cycle.

In a further example, the wearable airfoil is tethered between a torso and an arm location.

In a further example, the wearable airfoil is tethered between a torso and a wrist location.

In a further example, the wearable airfoil is tethered between a shoulder and an arm location.

In a further example, the wearable airfoil is tethered between a shoulder and a wrist location.

In a further example, the wearable airfoil is tethered between a back of the ankle location and a back of the leg location. In a further example, the back of the leg location is an upper portion of the adductor longus.

In one further example, the wearable garment comprises airfoils tethered on the arms and airfoils tethered on the torso.

In one further example, the wearable garment comprises airfoils tethered for the arms and airfoils tethered for the torso and airfoils tethered for the legs.

In one example, a system two or more wearable garments combine to provide airfoils tethered for the arms or the torso and airfoils tethered for the legs.

In one example, a system two or more wearable garments combine to provide airfoils tethered for the arms and airfoils tethered for the torso and airfoils tethered for the legs.

The current invention advances various techniques to significantly reduce the Aerodynamic Drag Forces on a cyclist for various body types and postures through the pedal cycle.

Aerodynamic principles are used to construct a cyclist garment that has a much more aerodynamically efficient shape than the current riding garments. The garment is comfortable, body conforming and significantly reduces the Drag generated by the Arms, Legs and Torso of the cyclist.

The garment is ergonomic and the various components of the garment can be assembled independently. The Leggings are interchangeable to the rider's shorts and the Arms are interchangeable to the rider's jersey.

In one version of the garment the cyclist can independently adjust the Aerodynamic efficiency generated by the garment Arms or Leg Airfoil components.

Figure 1:
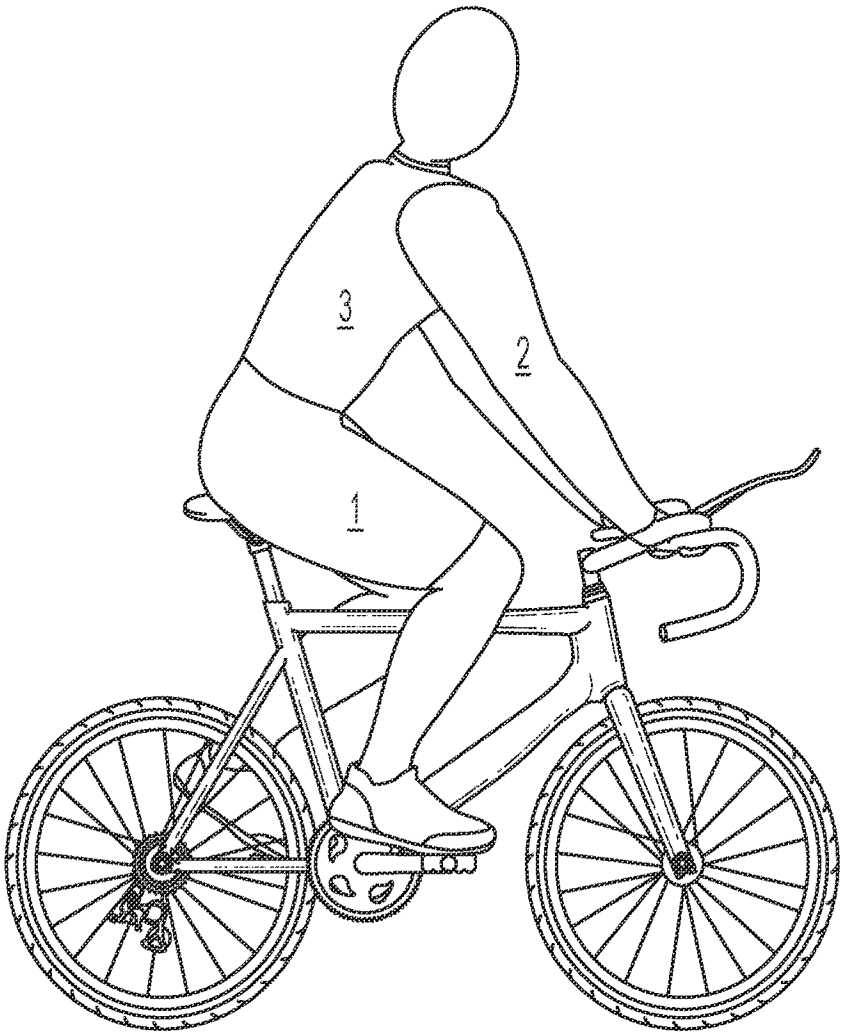
FIG. 1 is a right side view of a biker on a bicycle traversing from left to right, the right pedal in a zero degree (0°) position, with stretched arms to the handle bars in a first posture position, with a long sleeve jersey.

FIG. 1 is a right side view of a biker on a bicycle traversing from left to right, the right pedal in a zero degree (0°) position, with arms in a first posture position, with a long sleeve jersey. FIG. 1 shows a bicycle rider on a bicycle, illustrating the biker in a mid-pedal position. The two pedals are at approximately at the same horizontal elevation, with the right foot and pedal in the forward position, which will be called the zero degree (0 degree) position. The legs are bent at the knee. As illustrated, the right femur is roughly at −45 degrees and the right tibia is at approximately +80 degrees. The right knee angle is therefore approximately 65 degrees. This forms two sides of a virtual triangle. At moderate bike speeds, or equivalent headwind, for example fifteen to twenty miles per hour, the leg encounters an amount of air resistance. This resistance can be expressed in watts of power needed to overcome the headwind. For example, the resistance caused by the legs can represent thirty to forty percent of the total energy that the biker needs to expend to overcome aerodynamic drag, depending on the position of the torso.

Three basic wearable garment components are introduced in FIG. 1. In this example, riding shorts 1 cover the pelvic and upper leg region of the biker. Jersey sleeves 2 cover the arms of the biker. A bodice 3, or jersey torso, cover the torso region of the biker. In a biker example, the garment components are made of a stretching, body-conforming material. In one example, the garment material is of a lycra-type material. Various types of materials will stretch in both perpendicular directions, enabling close conformance to the shape of the body and decreasing drag from otherwise floppy clothing.

Figure 2:
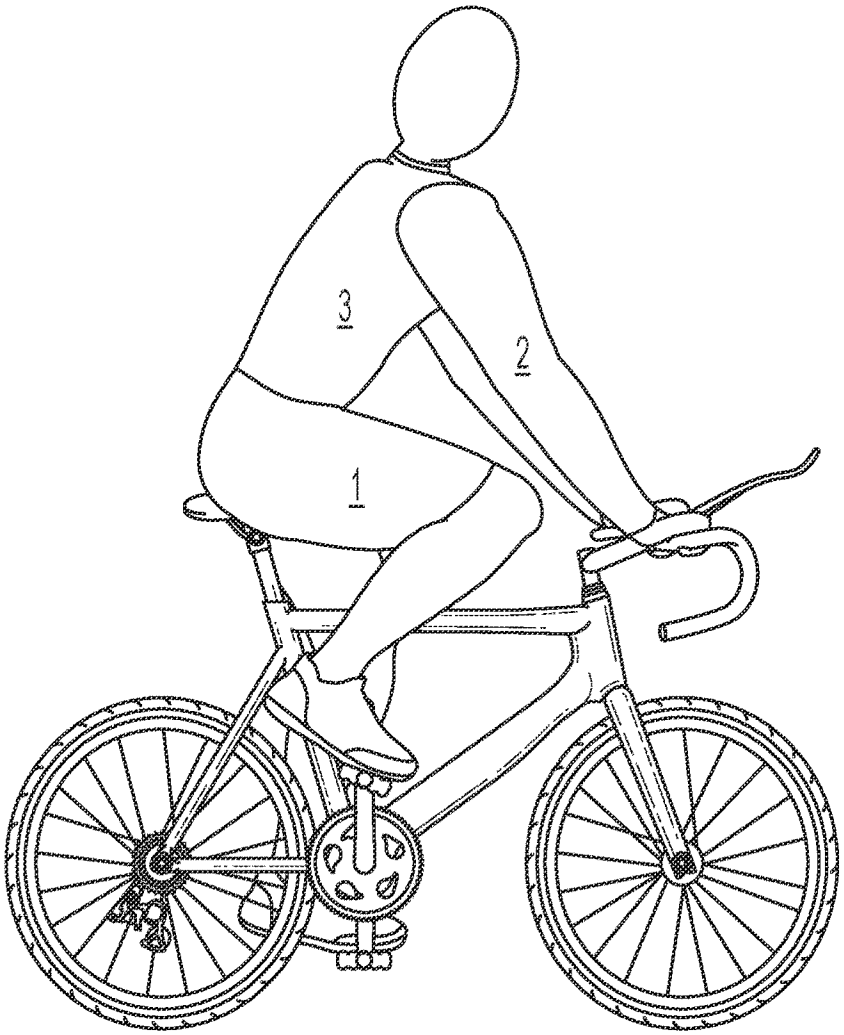
FIG. 2 is a right side view of a biker on a bicycle traversing from left to right, the right pedal in a ninety degree (8°) position, with stretched arms to the handle bars in the first posture position, with a long sleeve jersey.

FIG. 2 is a right side view of a biker on a bicycle traversing from left to right, the right pedal in a ninety degree (90°) position, with arms in the first posture position, with a long sleeve jersey. FIG. 2 shows a bicycle rider on a bicycle, illustrating the biker's right foot in a up-pedal position, the left foot in a full down-pedal position. The right pedal is at approximately the plus ninety-degree (+90 degree) position. The right leg is fully bent at the knee. As illustrated, the right femur is roughly at −15 degrees and the right tibia is at approximately +50 degrees. The knee angle is therefore approximately 65 degrees. This forms two sides of a virtual acute triangle.

For convenience, FIG. 2 shows riding shorts 1 and jersey sleeves 2 and bodice 3.

Figure 3:
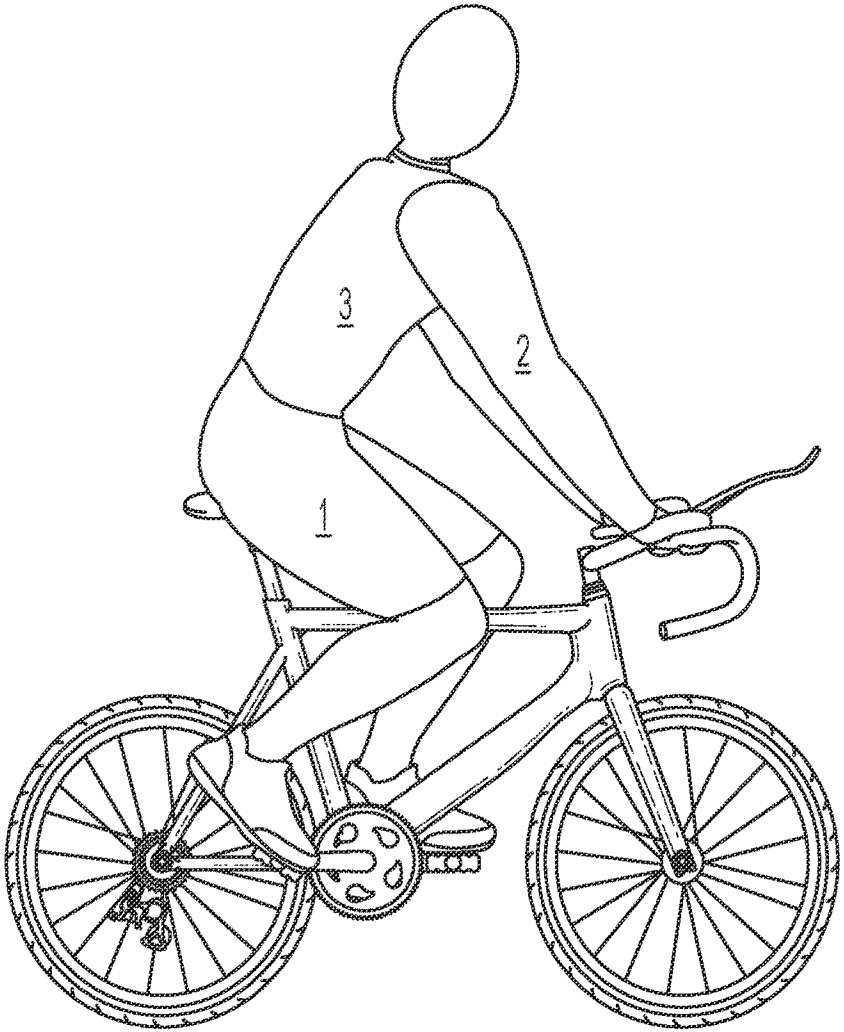
FIG. 3 is a right side view of a biker on a bicycle traversing from left to right, the right pedal in a one hundred eighty degree (180°) position, with stretched arms to the handle bars in the first posture position, with a long sleeve jersey.

FIG. 3 is a right side view of a biker on a bicycle traversing from left to right, the right pedal in a one hundred eighty degree (180°) position, with arms in the first posture position, with a long sleeve jersey. FIG. 3 shows a bicycle rider on a bicycle, illustrating the biker in a mid-pedal position. The two pedals are at approximately at the same horizontal elevation, with the right foot and pedal in the back position, which will be called the minus one hundred eighty degree (−180 degree) position. The legs are bent at the knee. As illustrated, the right femur is slightly lower than shown in FIG. 1, roughly at −50 degrees but the right tibia is at approximately +40 degrees. The right knee angle is therefore approximately 90 degrees. This forms two sides of a virtual triangle.

For convenience, FIG. 3 shows riding shorts 1 and jersey sleeves 2 and bodice 3.

Figure 4:
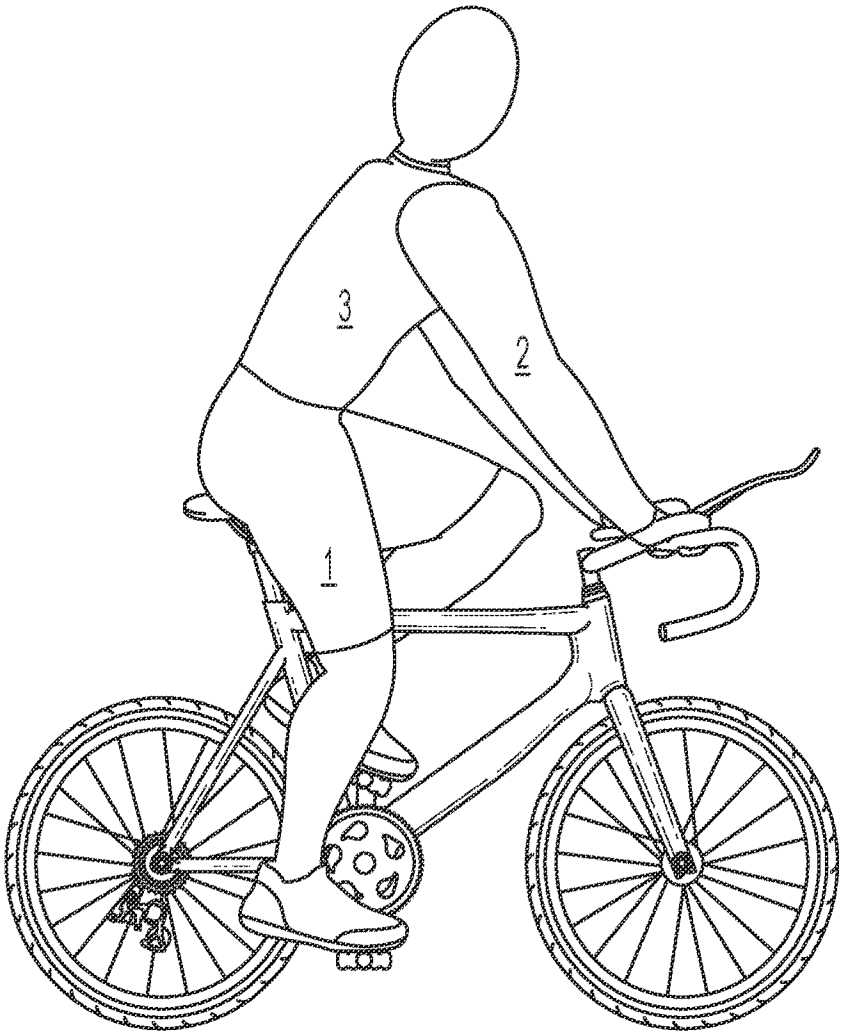
FIG. 4 is a right side view of a biker on a bicycle traversing from left to right, the right pedal in a two hundred seventy degree (270°) position, with stretched arms to the handle bars in the first posture position, with a long sleeve jersey.

FIG. 4 is a right side view of a biker on a bicycle traversing from left to right, the right pedal in a two hundred seventy degree (270°) position, with arms in the first posture position, with a long sleeve jersey. FIG. 4 shows a bicycle rider on a bicycle, illustrating the biker's right foot in a down-pedal position, the left foot in a full up-pedal position. The right pedal is at approximately the minus ninety-degree (−90 degree) position. The right leg is mostly fully extended at the knee. As illustrated, the right femur is roughly at −80 degrees and the right tibia is at approximately +85 degrees. The knee angle is therefore approximately 165 degrees. This forms two sides of a virtual acute triangle.

For convenience, FIG. 4 shows riding shorts 1 and jersey sleeves 2 and bodice 3.

Figure 5A:
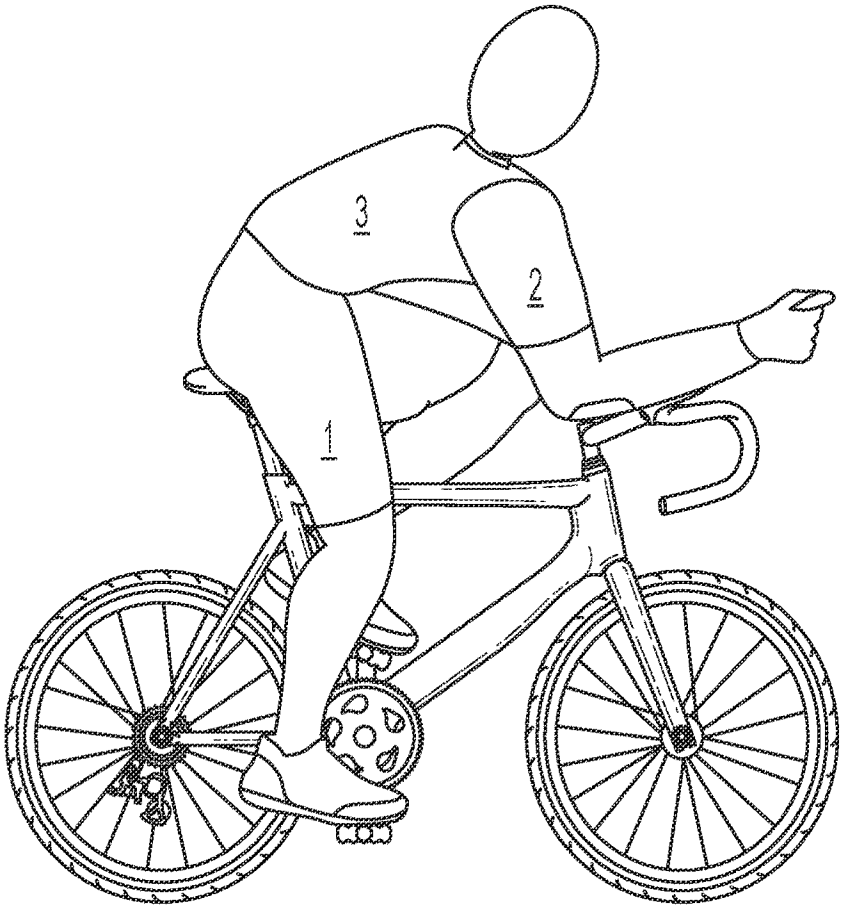
FIG. 5A is a right side view of a biker on a bicycle traversing from left to right, the right pedal in the two hundred seventy degree (270°) position, with arms in a second posture position, with a short sleeve jersey.
Figure 5:
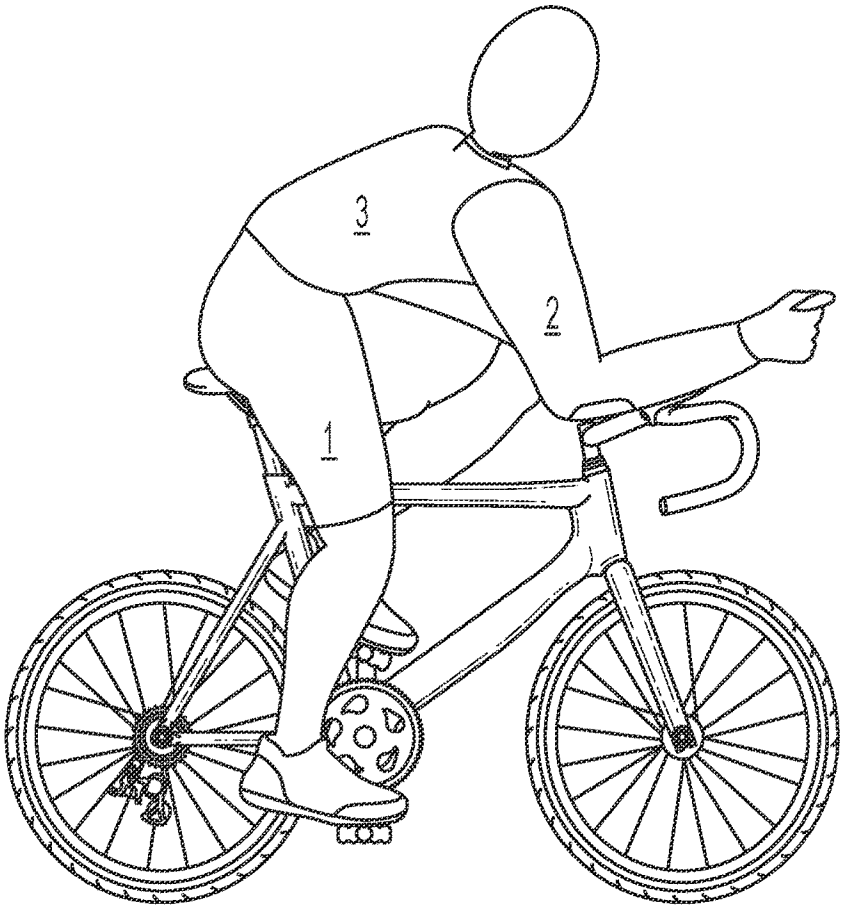
FIG. 5 is a right side view of a biker on a bicycle traversing from left to right, the right pedal in the two hundred seventy degree (270°) position, with bent arms and elbows resting on aero bars in a second posture position, with a long sleeve jersey.

FIG. 5 is a right side view of a biker on a bicycle traversing from left to right, the right pedal in the two hundred seventy degree (270°) position, with arms in a second posture position, with a long sleeve jersey. FIG. 5 shows a bicycle rider on a bicycle, illustrating the biker's torso and arm position when the biker's forearms are at rest at the handle bars. In this FIG. 5, the biker's right leg is in the right pedal full down position, as shown in FIG. 4. In this posture, the torso is roughly at +63 degrees and the arms roughly at +130 degrees. The forearm is in a straight, extended position. At moderate bike speeds, or equivalent headwind, for example fifteen to twenty miles per hour, the torso and arms encounter an amount of air resistance. This resistance can be expressed in watts of power needed to overcome the headwind. For example, the resistance caused by the torso, in this posture, can represent 45 percent of the total energy that the biker needs to expend. The arms can represent roughly 25 percent of the total energy that the biker needs to expend to overcome aerodynamic drag.

For convenience, FIG. 5 shows riding shorts 1 and jersey sleeves 2 and bodice 3.

FIG. 5A is a right side view of a biker on a bicycle traversing from left to right, the right pedal in the two hundred seventy degree (270°) position, with arms in a second posture position, with a short sleeve jersey.

Figure 6:
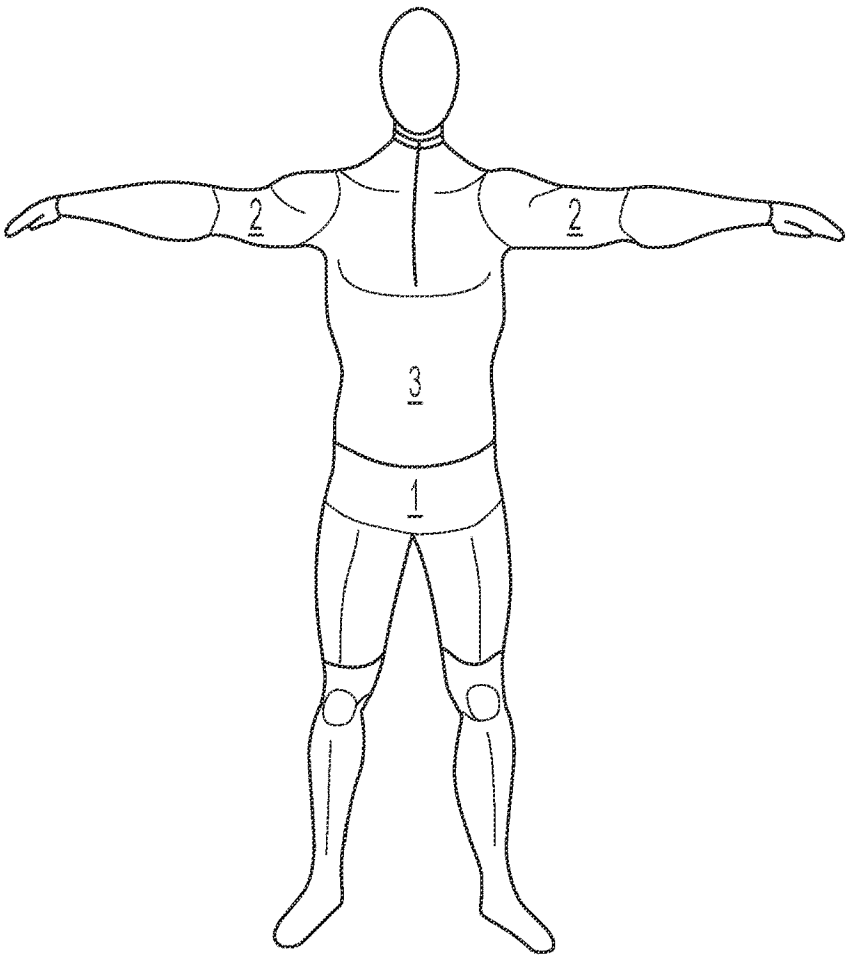
FIG. 6 is a 3-D perspective frontal view of a representation of a human body with arms extended in shorts and a long sleeve jersey.

FIG. 6 is a 3-D perspective frontal view of a representation of a human body with arms extended horizontally. For convenience, FIG. 6 shows positioning of riding shorts 1 and jersey sleeves 2 and bodice 3.

Figure 7:
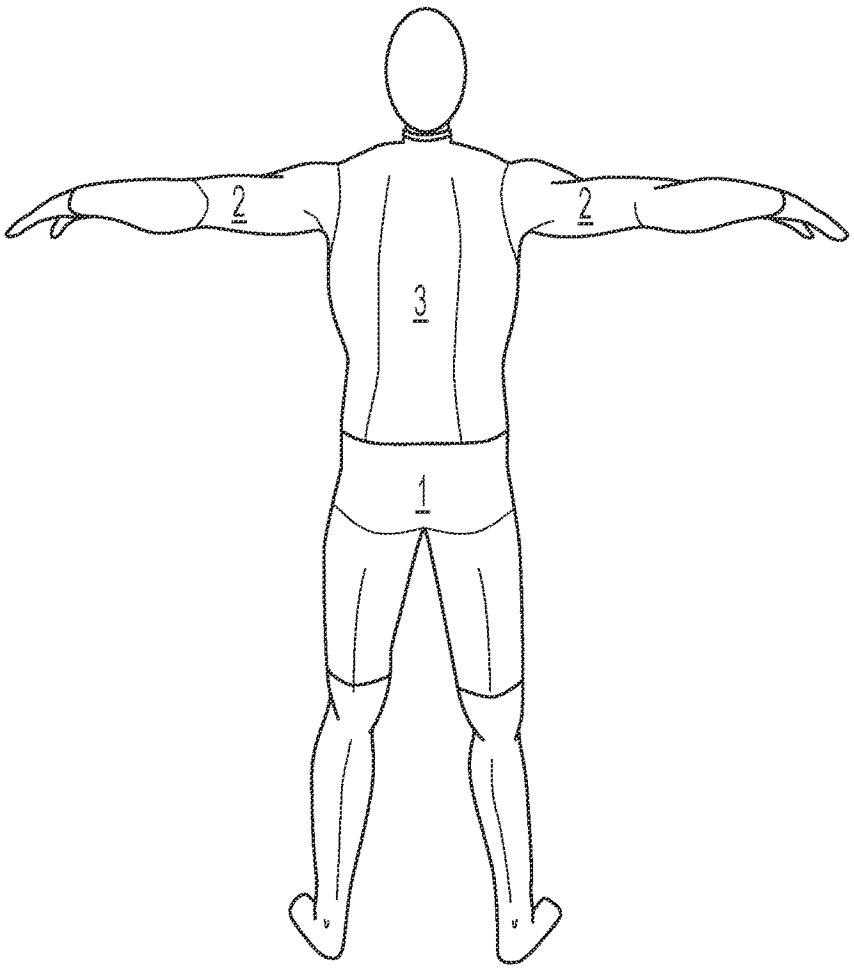
FIG. 7 is a 3-D perspective rear view of a representation of a human body with arms extended, with a long sleeve jersey.

FIG. 7 is a 3-D perspective rear view of a representation of a human body with arms extended horizontally. For convenience, FIG. 7 shows positioning of riding shorts 1 and jersey sleeves 2 and bodice 3.

Figure 8:
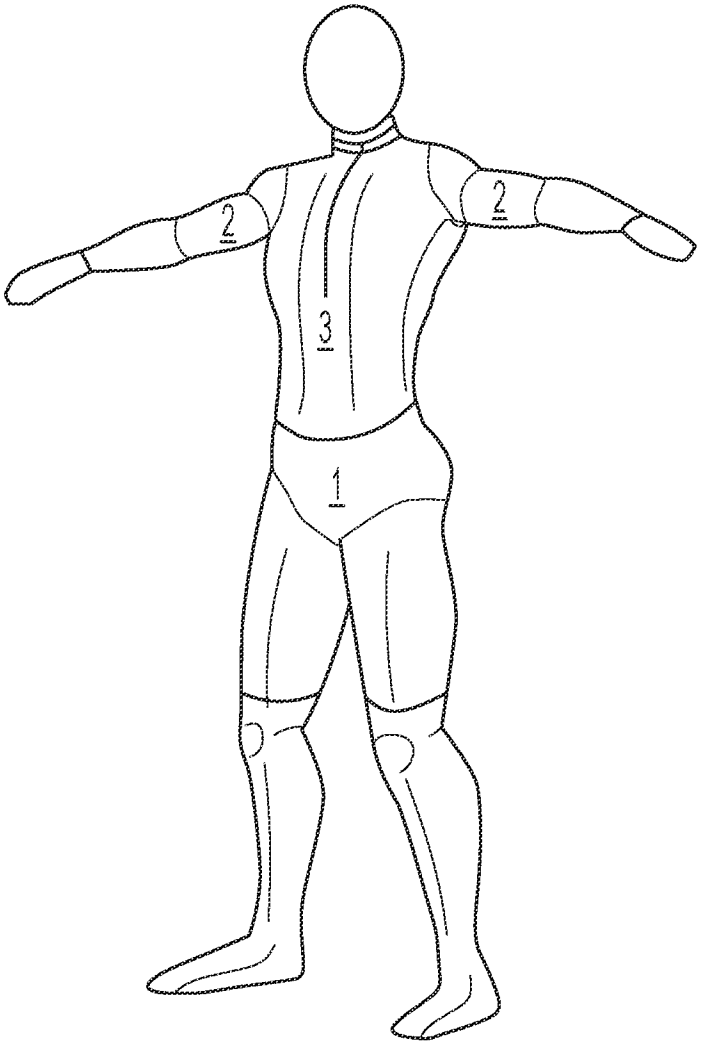
FIG. 8 is a 3-D perspective frontal left side view of a representation of a human body with arms extended sideways, with a long sleeve jersey.

FIG. 8 is a 3-D perspective frontal left side view of a representation of a standing human body with arms extended sideways. For convenience FIG. 8 shows positioning of riding shorts 1 and jersey long sleeves 2 and bodice 3.

Figure 9:
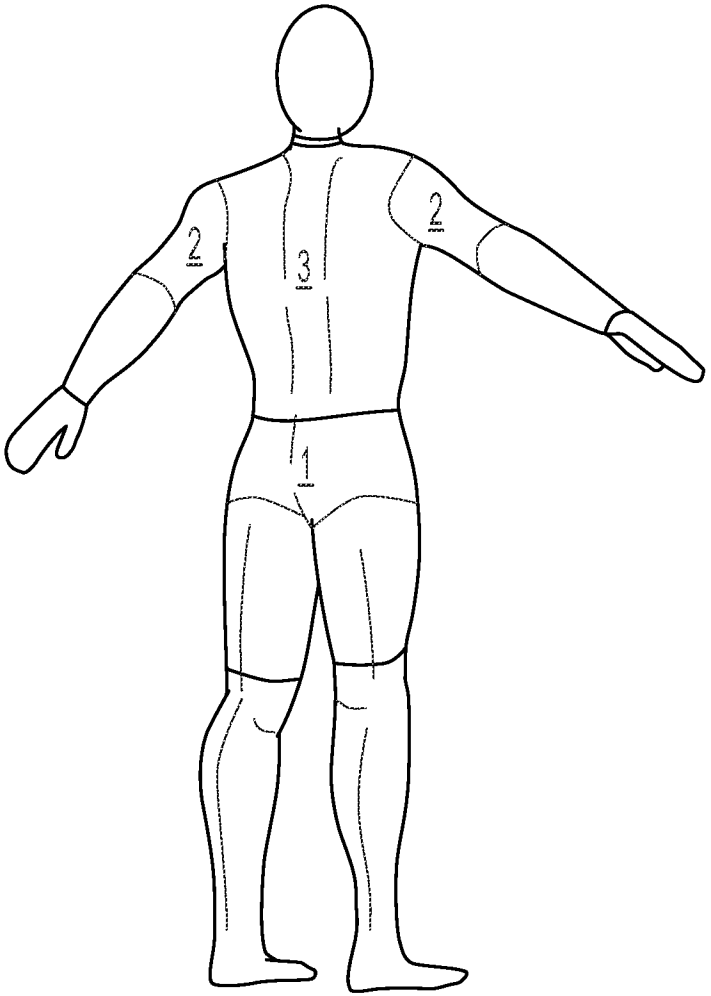
FIG. 9 is a 3-D perspective rear right side view of a representation of a human body with arms extended sideways, with a long sleeve jersey.

FIG. 9 is a 3-D perspective rear right side view of a representation of a standing human body with arms extended sideways. For convenience FIG. 9 shows positioning of riding shorts 1 and jersey long sleeves 2 and bodice 3.

FIG. 10 is a right side view of a biker on a bicycle traversing from left to right, showing placement of an example of the leg airfoil and placement of an example of the upper body torso airfoil and placement of an example of the upper body arm airfoil, with the right pedal in a zero degree (0°) position, with arms in a first posture position, with long sleeve jersey.

Riding Shorts & Airfoil Legging Assembly 100.

Leg airfoil assembly 100 substitutes for garment component riding shorts 1. As seen in this biker position, a garment portion of leg airfoil assembly 100 forms a web, an airfoil surface 102, between the gluttons and the ankle, behind the leg. In one example, the garment material of surface 102 is a stretchable, body-conforming material that allows for the stretching and suspension between the gluttons and ankle. In this extended position, the distance between the gluttons and ankle are at a mid-extended position, creating an aerodynamically efficient surface airfoil with low thickness to chord ratio.

As will be further described and illustrated, other features and structural components enable the formation of this changeable or transient airfoil as part of the wearable garment. In one example, an elastic band 104 is tethered between the gluttons and the ankle region, suspending surface 102 to form the airfoil. In one example, the elastic band 104 is cusped shaped and attached or integrated into the garment material that forms surface 102, thereby creating a trailing edge.

In one example, a front garment portion 103 of leg airfoil assembly 100 covers the front portion of the leg and attaches along a seam to the garment material of surface 102 that forms the transient airfoil. These structural features will be detailed further, herein.

For convenience, a dotted line 1' is shown to illustrate the positioning of the originally illustrated riding shorts 1.

Riding Jersey Sleeves & Airfoil Jersey Sleeves Assembly—Arm Airfoil Assembly 200.

Arm airfoil assembly 200 substitutes for garment component jersey sleeves 2. As seen in this biker position, the arms in a first posture position gripping the top of the handlebars, a garment portion of arm airfoil assembly 200 forms a web, an airfoil surface 201, between the upper torso (top of shoulder) and the wrist, and airfoil surface 202 under the arm and enclosing the armpit. In one example, the garment material of surface 201 is a stretchable, body-conforming material that allows for the stretching and suspension between the torso and wrist. In this first posture position, the distance between the torso and wrists are at a mid-extended position, creating a surface area airfoil faring under the arms.

As will be further described and illustrated, other features and structural components enable the formation of this changeable or transient airfoil as part of the wearable garment. In one example, an elastic band 211 is tethered between the shoulder bodice 302 region and the wrist, suspending surface 201 over the arm, to form the arm airfoil. In one example, band 211 is bluff shaped and attached or integrated into the garment material that forms surface 201, thereby creating a leading edge. In one example, the bluff leading edge of band 211 is anchored in the shoulder region on one end (see, 209 in FIG. 17) and anchored in the wrist region (see, 210 in FIG. 17) on the other end. These structural features will be detailed further, herein.

In one example, the elastic band 211 is tethered from one end at the bodice shoulder region by a floating anchor and tethered from the other end in the wrist region by a fixed anchor. Anchoring to the garment, in one example, is accomplished by affixing the end of the elastic band to the wearable garment. In another example, the anchoring is accomplished using an additional supporting band. In another example, to accomplish anchoring, a member is disposed on the garment that distributes the tension forces of the elastic band, distributing them over an area of the garment. This reduces the concentration of the force to reduce opportunity for ripping the garment. These structural features will be detailed further, herein.

Riding Jersey Torso & Body Conforming Upper Body Torso Airfoil Assembly 300.

Torso airfoil assembly 300 substitutes for bodice garment component or torso 3. As will be further detailed, herein, in one example, a flat elastic band seam 304 joins the arm portions (201 and 202) to the bodice portions (301 and 302) of the garment. In one example a flat elastic band seam 303 joins the bodice portions 301 and 302. In one example, a detachable flat elastic band seam 304 runs from the bottom of the shoulder joint 308 around the shoulder.

FIG. 11 is a right side view of a biker on a bicycle traversing from left to right, showing placement of an example of the leg airfoil and placement of an example of the upper body torso airfoil and placement of an example of the upper body arm airfoil, with the right pedal in a ninety degree (90°) position, with arms in the first posture position, but in this example the jersey is shown in its short sleeve version.

Leg airfoil assembly 100 substitutes for garment component riding shorts 1. As seen in this biker position, leg airfoil assembly 100 forms a web, an airfoil surface 102, between the gluttons and the ankle. In this example, the so-formed changeable or transient airfoil 102 is shown in a relaxed position due to the contracted distance between the gluttons and ankle. The airfoil surface area is reduced and the stretchable, body-conforming material retracts to maintain an airfoil shape with a bluff leading edge around the chin of the leg (103) and a cusp trailing edge (104). This roughly symmetric airfoil shape has airfoil thickness to chord ratios that reduce the aerodynamic drag of the otherwise naked leg. The lower thickness to chord ratios lead to a significant reduction of the form drag on the leg by muting the vortex shedding around the leg.

In one example, in this position, elastic line 104 is in its least stretched condition along its length. Since the knee is most fully bent, the lycra of the garment of surface 102 pulls on the elastic line 104, anti-parallel to and along its arch length. In one example, the lycra of the garment of surface 102 pulls on the elastic line 104, orthogonal to its arch length. The tension drawn by surface 102 is approximately normal to the axes of the leg bones. This forms an airfoil shape for surface 102 behind the leg and also forms a catenary arc shape for the length of elastic line 104, the leg airfoil trailing edge.

Therefore, the illustrated elastic line 104 is shown at its minimum longitudinal tension and maximum "normal" tension, the normal tension vectors provided by the direction of the expandable threads of rear foil piece 102.

Arm airfoil assembly 200 substitutes for garment component jersey sleeves 2.

Torso airfoil assembly 300 substitutes for bodice garment component or torso 3.

FIG. 12 is a right side view of a biker on a bicycle traversing from left to right, showing placement of an example of the leg airfoil and placement of an example of the upper body torso airfoil and placement of an example of the upper body arm airfoil, with the right pedal in a one hundred eighty degree (180°) position, with arms in the first posture position, with long sleeve jersey.

Leg airfoil assembly 100 substitutes for garment component riding shorts 1. As seen in this biker position, leg airfoil assembly 100 forms a web, an airfoil surface, between the gluttons and the ankle. In this example, the so-formed changeable or transient airfoil is shown in a relaxed position due to the contracted distance between the gluttons and ankle. Similar to the right leg forward, mid-pedal position, the airfoil surface area is reduced and the stretchable, body-conforming material retracts to maintain an airfoil shape with low thickness to chord ratios leading to significant reduction of the form aerodynamic drag on the leg by muting the vortex shedding around the leg.

FIG. 13 is a right side view of a biker on a bicycle traversing from left to right, showing placement of an example of the leg airfoil and placement of an example of the upper body torso airfoil and placement of an example of the upper body arm airfoil, with the right pedal in a two hundred seventy degree (270°) position, with arms in the first posture position, with short sleeve jersey.

Leg airfoil assembly 100 substitutes for garment component riding shorts 1. As seen in this biker position, leg airfoil assembly 100 forms a web, an airfoil surface, between the gluttons and the ankle. In this example, the so-formed changeable or transient airfoil is shown in a near fully-stretched position due to the extended distance between the gluttons and ankle. In this extended position, the distance between the gluttons and ankle are at a full-extended position, creating a relatively small surface area airfoil. The airfoil surface area is reduced and the stretchable, body-conforming material adapts with minimal resistance to the movement of the biker's leg. It should be noted that even in this most extended posture of the leg the airfoil generated by the leggings (102 and 103) still have lower thickness to chord ratios than the naked leg thus generating less aerodynamic drag.

It should be noted, however, that when the right leg assumes one posture, the left leg is in a 180 degree opposite posture. For example, when the right leg is in the posture of FIG. 13, then the left leg is in the corresponding posture of the right leg of FIG. 11. Likewise, when the right leg is in the posture of FIG. 12, then the left leg is in the corresponding posture of the right leg of FIG. 10.

Arm airfoil assembly 200 substitutes for garment component jersey sleeves 2.

Torso airfoil assembly 300 substitutes for bodice garment component or torso 3.

FIG. 14 is a right side view of a biker on a bicycle traversing from left to right, showing placement of an example of the leg airfoil surface 102 and placement of an example of the upper body torso airfoil and placement of an example of the upper body arm airfoil, with the right pedal in the two hundred seventy degree (270°) position, with arms in a second posture position, with long sleeve jersey. In this FIG. 14, the biker's right leg is in the right pedal full down position, as used in FIG. 4. FIG. 14 shows the biker's right leg in the position of FIG. 4 and FIG. 13, with an example of the leg airfoil assembly 100 of the present invention worn on the legs of the biker.

FIG. 14A is a right side view of a biker on a bicycle traversing from left to right, showing placement of an example of the leg airfoil surface 102 and placement of an example of the upper body torso airfoil, with the right pedal in the two hundred seventy degree (270°) position, with arms in a second posture position, with short sleeve jersey. Note that for the short sleeve jersey, in one example, there is no arm Airfoil.

FIG. 15 is a 3-D perspective frontal view of a representation of a human body with arms extended horizontally, similar to FIG. 6, showing positioning and arrangement of frontal portions of an example of the leg airfoil assembly 100 and upper body airfoils, long sleeve airfoil assembly 200 and torso airfoil assembly 300.

Riding Shorts & Airfoil Legging Assembly 100.

An upper garment piece of the leg airfoil assembly 100 serves as riding leggings or shorts 101 and serves to structurally hold the rest of leg airfoil assembly 100 onto the bike rider. Shorts 101 are the upper portion of the airfoil leggings, the riding shorts.

In one example, a front garment portion 103 of leg airfoil assembly 100 covers the front portion of the leg and attaches along a seam to shorts 101 as well as the garment material of surface 102 that forms the transient airfoil. Front garment portion 103 forms the front portion of the airfoil leggings, an extension of the riding shorts. In one example, front garment portion 103 attaches on the front of the leg, above the knee. In one example, front garment portion 103 is shaped to cover the front of the leg, symmetric about the shin line, from above the ankle to the lower portion of the front of the shorts, above the knee. The front piece is shaped, positioned and arranged to be in contact with the front of the leg, from over the knee through the shin to above the ankle. In one example, if the leg is viewed as a cylinder with the shin line being zero degrees, the front piece is shaped, positioned, and arranged to cover, in one example, between −80 to +80 degrees of the front of the leg. In one example, if the leg is viewed as a cylinder with variable cross section diameter and the shin—femur line being at zero degrees, the front piece is shaped, positioned and arranged to cover, in one example, at an angle between −120 and −80 degrees to an angle between +120 and +80 degrees off of the shin—femur line at the front of the leg.

In one example, a zipper seam line 107 joins the side and back of the upper portion of shorts 101 to the upper portion of the transient airfoil 102. In the example, the zipper seam line 107 joins the lower portion of the transient airfoil 102 to then lower portion of the front garment portion 103.

In one example, the angle location of the zipper seam line 107 with respect to the shin—femur line changes along the length of the leg over a range suitable to tripping the airfoil boundary layer.

In one example, a zipper seam line 108 joins the upper portion of the airfoil riding leggings, e.g., shorts 101 and the front portion of the airfoil riding leggings, e.g., front garment portion 103.

In one example, a flat elastic ankle band 109 is attached at or near the bottom of leg airfoil assembly 100. Ankle band 109 serves to assist in anchoring the bottom portion of leg airfoil assembly 100. This prevents the tension from band 104 (see FIG. 16) from pulling the legging up the leg.

In one example, the ankle band 109 is anchored to the foot by a sock like structure.

Riding Jersey Sleeves & Airfoil Jersey Sleeves Assembly—Arm Airfoil Assembly 200.

In one example, the arm airfoil assembly 200 uses two portions of garment attached to the bodice portion of the garment, a front portion of airfoil jersey sleeves 201 and a back or rear of airfoil jersey sleeves (as illustrated in FIG. 16, components ante-arm portion 202 and fore-arm portion 203). A seam line 207 joins the front portion of airfoil jersey sleeves 201 with the upper ante-arm portion 202 of the airfoil jersey and with the fore-arm portion 203 of the airfoil jersey from the shoulder to the wrist.

If the arm is viewed as a cylinder with variable cross section diameter and the thumb—radius—humerus line being at zero degrees, the front portion of the airfoil jersey sleeves 201 is shaped, positioned and arranged to cover, in one example, at an angle between −120 and −80 degrees to an angle between +120 and +80 degrees off of the thumb—radius—humerus line at the front of the arm.

In one example, the angle location of the seam line 207 with respect to the thumb—radius—humerus line, changes along the length of the arm over a range suitable to tripping the airfoil boundary layer.

As illustrated in FIG. 14 and FIG. 15, an elastic band 211 stretches from the wrist to the shoulder and functions to form an airfoil leading edge. In one example, elastic band 211 has a bluff shape to create the airfoil leading edge. In one example, the airfoil bluff leading edge elastic band 211 is disposed from a shoulder anchor 209 to a fixed wrist anchor 210.

In one example, additional anchoring strength is obtained by affixing to the garment a flat elastic wristband component 212. The wrist end of airfoil band 211, anchor point 209, attaches to the wrist band 212. This prevents tension from band 211 from pulling the sleeve up the arm.

In one example, the wrist end of band 211 is anchored to the hand by a glove like structure.

Riding Jersey Torso & Body Conforming Upper Body Torso Airfoil Assembly 300.

The front side of garment component 302 of torso assembly 300 is shown. In one example, front side 302 attaches to the shorts 101 at the waist. Back or rear side 301 is shown in FIG. 16.

A flat elastic band seam at 303 runs along the sides of the body, joining the front side 302 to the back side 301 and anchoring components, which will be described further, herein.

In one example, a hip quick engage/release at 306 serves as a waist anchor between the body conforming airfoil jersey torso assembly 300 and the upper portion of airfoil leggings 101. The hip quick engage/release 306 is located on the side of the body, near the base of the joint of the front side garment component 302 and the back side garment component 301 (see FIG. 14).

A detachable flat elastic band seam 304 joins the bodice to the sleeves. Shoulder anchor point 209 is disposed at the band seam 304. A fixed torso anchor 308 (for the airfoil cusped trailing edge elastic band 204 shown in FIG. 16 and FIG. 16A) is disposed at the nadir of the arm opening of the bodice, at the band seam 304. The torso anchor 308 serves to anchor one end of the torso airfoil trailing edge that spans to the bottom of the arm at or near the elbow.

In a further example configuration, anchor point 209 is the shoulder anchor for an airfoil bluff leading edge elastic band 211. In one example, as illustrated, anchor 209 is disposed on sleeve garment portion 201 at or near the edge that joins with the bodice (elastic band 304). A bluff leading edge 211 spans from shoulder anchor point 209 to a fixed wrist anchor 210. In one example, a flat elastic wrist band component 212 wraps around the wrist, providing resistance in the longitudinal direction along the axis of the arm. This keeps the bluff edge 211 from pulling up the arm the wrist anchor 210. As can be appreciated, bluff elastic band 211 is composed so as to stretch and relax in response to the relative movements of the arm and torso to each other. This enables the airfoil to deploy and collapse as needed, without impairing the movements of the user and without causing significant additional effort to move on the part of the user.

In one example, shoulder anchor 209 is an adjustable anchor, meaning that an adjusting member forms an anchor for one end of the bluff elastic band 211, at the shoulder end. This enables adjustment of the range of tension of the bluff elastic band 211 to suit the needs of the user. The desire or need for tension adjustment can be for any or all of a number of reasons. For example, more precise tension adjustment may be to better match a desired tension to the physical size of the wearer. In another example, the wearer or future research may find that a more specific tension is optimum than that provided if the bluff elastic band 211 were anchored at fixed anchor points at both ends. In another example, washing and wear and aging may affect the stretch of bluff elastic band 211. An adjustable or floating anchor enables future calibration of the tension of the bluff elastic band 211 for enhanced aerodynamic performance.

In can be appreciated that the specific examples described and/or illustrated herein are currently preferred examples. In further examples, it can be appreciated that the other edge elastic bands disclosed herein will have at least one floating or adjustable anchor. In further examples, a floating or adjustable anchor serves by adjusting the tension of the edge elastic band (by physically shortening or lengthening the length of the band between the anchors for a particular amount of tension applied). In other examples, the floating or adjustable anchor is disposed at a fixed location on the garment. In other examples, the floating or adjustable anchor is disposed with an adjustable location on the garment. In other examples, both ends are anchored with floating or adjustable anchors. In other examples, both ends are anchored with fixed anchors. In a range of other examples, applicant is disclosing all combinations of fixed-fixed, fixed-adjustable, floating-adjustable anchoring pairs and is disclosing all combinations of choices of type of floating or adjustable anchor (garment-fixed and garment-location-adjustable).

FIG. 15A is a partial 3-D perspective frontal view showing placement of an example of the upper body torso airfoil only, on a short sleeve jersey, without arm airfoil. In this example configuration, the sleeve above the elbow serves as the anchor location for the end of the torso airfoil.

Flat elastic band seam at 303 along the side of the torso is also shown for reference. A zippered or otherwise detachable flat elastic band seam 304 runs along the armsyce, connecting the front of the torso garment portion 302 to the front portion of jersey arm garment portion 201 and connecting the back of the garment portion 301 (see FIG. 16) to the back portion of the jersey arm garment portion 202 (see FIG. 16). In this example, garment portion 201 is "short sleeve', running to the elbow location on the arm. In one example, seam line 207 is disposed between the upper front portion of garment component 201 of the airfoil jersey sleeves and the ante-arm portion 202 of the airfoil jersey from the shoulder to the elbow.

In one example, a flat elastic elbow band 206 is attached above or near the elbow of the front portion of the airfoil jersey sleeves 201 and the back portion of the airfoil jersey sleeves 202 (see FIG. 16) of airfoil assembly 200. The elbow band 206 wraps around the arm. The elbow band 206 serves to assist in anchoring the distal portion of torso airfoil assembly 300.

FIG. 16 is a 3-D perspective rear view of a representation of a human body with arms extended horizontally, showing positioning and arrangement of the rear portions of an example of the leg and upper body (torso and arm) airfoils. FIG. 16 shows the biker in the position of FIG. 7 with an example of the airfoil pants 100 of the present invention worn on the legs of the biker. In this posture/position, elastic line 104 is in its most stretched condition along its length, anchored at its ends by anchors 105 and 106. In this posture, the airfoil is shaped and positioned in a least effective contribution to the drag reduction.

In one example, elastic line 104 is an airfoil cusped trailing edge elastic band. The rear foil piece 102 (also illustrated in FIG. 18) is shaped to envelope and drape behind the leg, hinging along an elastic line 104. In one example, elastic line 104 is attached to rear foil piece 102 along the length axis of piece 102, thereby draping behind the leg.

In one example, the airfoil legging portion 102 of legging assembly 100 is attached to biking shorts 101 along a seam line 107. In one example, this makes the airfoil field-detachable from the shorts. In one example, a seam line 107 runs from one side of the ankle anchor 106, up to an elevation proximate to leg anchor 105, running then across the back of the leg, and down the other side of the leg back to the other side of the ankle anchor 106. In one example, a zipper forms this seam line 107. The purpose of this seam line 107 is to enable detachment of the lower, airfoil portion 102 of the leggings 100 so that the user may selectively wear or take off the airfoil 102 without having to remove the riding shorts 101 portion of the riding shorts and airfoil legging assembly 100. In one example, the lengths of the outer edges of front piece 103 and rear airfoil piece 102 are joined together along seam 107 (as illustrated in FIG. 17 and FIG. 18).

In one example, the front piece 103 and the transient rear airfoil 102 are joined together along seam 107, disposed at a variable angle between −120 and −80 degrees to an angle between +120 and +80 degrees to the shin—femur line at the front of the leg.

Ankle anchor point 106 illustrates one example of the termination point for the bottom of the cusp elastic line 104. In this example, it is shown slightly above the ankle and behind the leg.

Leg Anchor point 105 illustrates one example of the termination point for the top of elastic line 104. In this example, it is shown approximately two thirds of the length of the femur up from the knee, near the top of the femoris muscle, below the gluteus maximus, and on the back side of the leg. In one example, the leg point 105 is fixed or otherwise anchored to leggings 102. In one example, the leg point 105 is moveable over a fixed range to provide more comfort to the wearer.

Rear foil piece leggings 102 add a streamlined leg positioning conforming shape to the leg. The surface of piece 102 streamlines the flow of air around the leg by cutting vortex shedding and frequency, thereby reducing the drag resistance.

In one example, a compression band 109 is attached to the bottom of airfoil leggings 102. In one example, compression band 109 is a flat elastic anchor band component of an ankle anchor assembly. Band 109 is configured to hold the bottom of legging 102 firm around the leg just above the ankle, to prevent the bottom of the legging 102 from riding up the leg.

Thus, the bottom of cusp elastic line 104 is anchored at or near the location of band 109 in the rear (180 degree relative to the front shin) of assembly 100. The top of cusp elastic line 104 is anchored at the top of leggings 102 in the rear, below shorts portion 101 (180 degree relative to the front of the thigh).

In one example, ankle anchor 109 is an adjustable anchor, meaning that an adjusting member forms an anchor for one end of the cusp elastic band 104, at the ankle end. This enables adjustment of the range of tension of the cusp elastic band 104 to suit the needs of the user. The desire or need for tension adjustment can be for any or all of a number of reasons. For example, more precise tension adjustment may be to better match a desired tension to the physical size of the wearer. In another example, the wearer or future research may find that a more specific tension is optimum than that provided if the cusp elastic band 104 were anchored at fixed anchor points at both ends. In another example, washing and wear and aging may affect the stretch of the cusp elastic band 104. An adjustable or floating anchor enables future calibration of the tension of the cusp elastic band 104 for enhanced aerodynamic performance.

Riding Jersey Sleeves & Airfoil Jersey Sleeves Assembly—Arm Airfoil Assembly 200.

In one example, as illustrated in FIG. 14 and FIG. 16, a seam line 208 around the elbow region separates the ante-arm 202 and fore-arm 203 garment portions of the jersey sleeves. The jersey garment is separated into a front portion 201, and a back portion composed of the back ante-arm 202 and back fore-arm 203 components.

In one example, the arm airfoil assembly 200 uses two portions of garment attached to the bodice portion of the garment, a front portion of airfoil jersey sleeves 201 (as illustrated in FIG. 15) and the ante-arm portion of airfoil jersey sleeves 202 (as illustrated in FIG. 16). A seam line 207 joins the front portion of airfoil jersey sleeves 201 with the ante-arm back portion 202 of airfoil jersey sleeves. Seam line 207 also joins to the back fore-arm 203 portion of airfoil jersey sleeves.

In one example, the front portion of airfoil jersey sleeves 201 and the ante-arm portion 202 of airfoil jersey sleeves are joined together along seam 207, disposed along the arm at a variable angle between −120 and −80 degrees to an angle between +120 and +80 degrees with respect to the thumb—radius— humerus line.

In one example, as illustrated in FIG. 16, an elastic band 204 is disposed on the back of the arm, stretching from the armpit torso anchor 308 to the near the elbow at anchor 205. In one example, elastic band 204 is attached to the back ante-arm 202 portion of the jersey sleeves. In one example, elastic band 204 is an airfoil cusped trailing edge elastic band. One end of elastic band 204 is anchored at the base of the arm opening of the bodice (below the armpit) at torso anchor 308. The other end of elastic band 204 is anchored at or near the elbow, the elbow anchor 205. In one example, elbow anchor 205 is a floating anchor, as more fully described herein.

In one example, fixed torso anchor 308 serves to anchor a cusped leading edge elastic band 204 to the torso airfoil to assembly 300. Elbow anchor 205 and torso anchor 308 hold the cusped trailing edge elastic band 204 of the torso airfoil assembly. These anchor points hold the trailing edge as the arms and body move into and out of the various cycling positions.

In one example, as illustrated in FIG. 15 and FIG. 16, the back of elastic wristband 212 is visible. The wristband 212 is used to provide additional anchoring of the bluff leading edge 211 of the arm airfoil.

Riding Jersey Torso & Body Conforming Upper Body Torso Airfoil Assembly 300.

Back side 301 and front side 302 of the torso body conforming airfoil riding jersey, the bodice, are is shown attached along a detachable the flat elastic seam 303 and a waist anchor 306. They are further attached to the arms along a zippered or otherwise detachable seam 304 and torso anchor 308. The waistband 305 wraps around the waist and, in one example, includes a two-finger quick-release and engaging mechanism at the waist anchor, disposed on the sides of the body at the hip. In one example, waist anchor 306 is a two-finger quick-release mechanism that allows the user to quickly and easily detach the torso assembly 300 from the legging assembly 100. A flat elastic seam 303 is disposed vertically along the sides of the torso between the back side 301 and the front side 302 of the body conforming bodice and also to the fixed torso anchor 308. Thus, in one example, fixed anchor 308 is a relatively complex three-way juncture of elastic bands, which will be described in more detail, herein.

In should be appreciated, in all examples of anchors, that the anchors are configured, positioned, and arranged to spread the forces caused by the elastic bands across an area of the garment. This reduces the point-force pull on the garment, reducing the tendency for the garment to separate or be torn from the elastic band.

FIG. 16A is a partial 3-D perspective rear view showing placement of an example of the upper body torso airfoil only, on a short sleeve jersey, without arm airfoil. An elastic band 204 is disposed along the back of the arm, from the elbow to the torso. Seam 207 line forms the joint between two garment portions of the sleeves, namely front portion 201 and back ante-arm portion 202. Seam line 207 runs from the top of the shoulder portion of the arm to the elbow. In one example, elastic band 204 is a cusped trailing edge for the airfoil. The cusp elastic band is run between, and anchored to an elbow anchor 205 and a torso anchor 308. In one example, elbow anchor 205 is a floating anchor. In one example, torso anchor 308 is a fixed anchor.

In one example, an elastic band 206 wraps around the arm in the vicinity of the elbow, to provide additional anchoring support for the elbow anchor 205.

FIG. 17 is a 3-D perspective frontal left side view of a representation of a standing human body with arms extended sideways, showing positioning and arrangement of frontal-side portions of an example of the leg and upper body (torso and arm) airfoils.

In one example, the lengths of the outer edges of front piece 103 and rear foil piece 102 are joined together along seam 107 (as illustrated in FIG. 17 and FIG. 18). In one example, seam 107 is field-detachable. In one example, seam 107 is a zippered seam, enabling removal of garment portions 102 and 103 from the rest of the shorts 101. In one example, a zipper seam line 108 traverses the front of the leggings 101, 103 to enable removal of the airfoil from the shorts.

In one example, the transient rear airfoil 102 is joined to the front piece 103 and the stretchable shorts 101 along seam 107, disposed at a variable angle between −120 and −80 degrees to an angle between +120 and +80 degrees with respect to the shin—femur line at the front of the leg.

For reference, elastic band 109 is shown wrapped around the ankle, becoming a part of an ankle anchor assembly. In one example, elastic band 109 is a flat elastic band, as further detailed, herein.

From this perspective, as illustrated, the front portion 201 of the airfoil jersey sleeves are more fully shown. Again, seam line 207 joining front portion 201 to back fore-arm portion 202 runs along from the top of the shoulder to the end of the sleeve, here, at the wrist anchor 210 on the wristband 212. The bluff edge 211 of the airfoil is disposed on the sleeve midway along the front of the arm, from the wrist to the seam 304 connecting the bodice at the shoulder anchor 209. In one example, the leading edge 211 is an elastic band having an airfoil bluff leading edge. In one example, the leading edge elastic band 211 is anchored between the shoulder anchor 209 and wrist anchor 210. In one example, shoulder anchor 209 is a floating or adjustable anchor. In one example, anchor 209 is disposed at the intersection with bodice front portion 302. In one example, anchor 209 is connected to elastic band seam 304. Bodice back portion 301 is shown joined to front portion 302 by seam 303.

In one example, the front portion 201 is joined at the torso triple anchor 308. In one example, the torso triple-anchor 308 is a junction between a flat elastic band 303 and flat elastic band 304 and a cusp trailing edge 204 of the torso airfoil. In one example, flat elastic band 304 is zippered or otherwise detachable.

In one example, an elastic band 211 is tethered between the bodice 302 region and the wrist, suspending surface 201 over the arm, to form the airfoil. In one example, band 211 is bluff shaped and attached or integrated into the garment material that forms surface 201, thereby creating a bluff leading edge. In one example, the bluff leading edge of elastic band 211 is anchored in the shoulder region on one end 209 and anchored in the wrist region 210 on the other end.

FIG. 17A is a 3-D perspective frontal left side view showing placement of an example of the upper body torso airfoil only, on a short sleeve jersey, without arm airfoil. In the absence of an arm airfoil, the leading edge elastic band 211 does not exist on the front garment portion 201 of the short sleeve version of the airfoil jersey sleeves. Again, seam line 207 joining front portion 201 to upper back portion 202 runs along from the top of the shoulder to the end of the sleeve, here, the elbow region. In one example, a band 206 wraps around the elbow region of the arm, providing additional anchoring support for the cusped leading edge 204 of the torso airfoil, whose other end is anchored at fixed torso anchor 308. The torso anchor 308, being a triple juncture, rests at the arm opening (armpit) of the bodice and connects to seam 304. In one example, anchor 308 further connects to a flat elastic band Seam 303 joining the back 301 and the front 302 of the bodice. In one example, seam 304 allows field-detachment of the sleeves from the bodice, including detachment of the airfoil edge. In one example, seam 304 is zippered or otherwise detachable.

FIG. 18 is a 3-D perspective rear right side view of a representation of a standing human body with arms extended sideways, showing positioning and arrangement of rear-side portions of an example of the leg and upper body (torso and arms) airfoils.

The major components exposed from this perspective include the rear portion of shorts 101, the rear garment portion of the airfoil leggings 102 (the riding shorts extension), the upper back garment portion of airfoil jersey sleeves 202, and the lower back garment portion of airfoil jersey sleeves 203.

From this perspective, the elastic edge band 104 for the leg airfoil is disposed on garment portion 102. Anchor 105 on garment portion 102 at the upper back of the leg holds one end of elastic edge band 104. The other end of elastic edge band 104 is held by anchor 106 on garment portion 102 at the ankle. A band 109 wraps around the ankle, attached to garment portion 102 and attached to anchor 106, keeps the leading edge 104 from pulling on the end of the leggings, keeping the leggings from riding up the leg. Garment portion 102 forms the airfoil and is shaped to envelope and drape behind the leg, hinging along elastic band 104.

From this perspective, the torso airfoil edge 204 is visible. Torso airfoil edge 204 is disposed on the upper back garment portion 202 to span the airfoil in the armpit region. In one example, torso airfoil edge 204 is an elastic band that is attached and stretches and pulls garment portion 202 to form the trailing edge of the torso airfoil. In one example, torso airfoil edge 204 has a cusped shaped edge. In one example, anchor 205 is disposed on the back ante-arm garment portion 202 near the elbow edge at the elbow anchor. Triple juncture anchor 308 is disposed at the armpit intersection of seam 304 and seam 303. One end of airfoil edge 204 attaches at the torso anchor 308. The other end of airfoil edge 204 attaches at the elbow anchor 205. Thus, a changeable, transient airfoil surface is accomplished through a combination of type of garment material, positioning and arrangement of stretchable band disposed on the garment material, forming an edge, and position and arrangement of anchoring of the edge to the garment material. In one example, seam 304 is a zippered seam.

In one example, on the legs, a detachable seam 107 joins rear garment portion 102 to shorts 101 and to the front garment portion 103. Seam 107 runs in a horseshoe shape from the ankles up the upper legs below the gluteus and across the back of the legs and back down to the ankles. A detachable seam 108 above the knee runs across the front of the legs and joins front garment portion 103 to shorts 101. These seams enable the airfoil portion of the leggings (102, 103, 104) to be field-detachable from the shorts 101. In this way, the user is able to selectively add or remove the airfoil portion as desired during a riding journey. In one example, different styles of the lower leggings (102, 103, 104) are attachable, enabling different style or color combinations. In one example, differently engineered lower leggings (102, 103, 104) are attachable, enabling field-change-out of airfoils with different performance characteristics. In one example, detachable seam 107 is a zippered seam.

FIG. 18A is a 3-D perspective rear right side view showing placement of an example of the upper body torso airfoil only, on a short sleeve jersey, without arm airfoil.

From this perspective, airfoil edge band 204 is shown disposed on the upper back garment portion 202 of a short sleeve jersey. A band 206 wraps around the arm in the region near the elbow, keeping the short sleeve from riding up the arm due to pulling by the airfoil edge band 204.

DISCUSSION

In one example, disclosed herein is a method for reducing cyclist aerodynamic drag comprising: wearing a garment adapted to receive a collapsible airfoil; performing one or more steps chosen from: (a) suspending a cloth surface airfoil between a location proximate to the wrist and the shoulder of the garment; (b) suspending a cloth surface airfoil between a location proximate to the back of the ankle and the back of the leg (upper portion of the adductor longus) of the garment; and (c) suspending a cloth surface airfoil between a location along the back of the arm and a location on the torso of the garment; stretching the cloth surface airfoil in response to changes in body movement while cycling; and relaxing the cloth surface airfoil in response to changes in body movement while cycling.

In one example, disclosed is an airfoil garment comprising: a wearable garment; one or more stretchable suspension lines disposed on the garment between one or more of the following combinations of proximate locations: (a) the wrist and the shoulder; (b) the back of the ankle and the back of the leg (upper portion of the adductor longus); and (c) along the back of the arm and a location on the torso; for each stretchable suspension line, a flexible and stretchable cloth material is attached to and forming a portion of the garment; and wherein the flexible and stretchable cloth material is attached to the stretchable suspension line, forming a draped and collapsible airfoil.

In a further example, the flexible and stretchable cloth material forming the airfoil is detachable from the rest of the garment.

In a further example, the flexible and stretchable cloth material forming the airfoil is made of lycra-type material.

In a further example, the garment and flexible and stretchable cloth material forming the airfoil is made of lycra-type material.

In a further example, the one or more stretchable suspension lines forms a cusp shape, whereby a trailing edge is formed. In a further example, the cusp shape suspension line is disposed between the back of the ankle and the back of the leg (in one example, the upper portion of the adductor longus).

In a further example, the one or more stretchable suspension lines is shaped to form a bluff leading edge. In a further example, the bluff leading edge suspension line is disposed between a location proximate to the wrist and the shoulder of the garment.

In one example, disclosed is an aerodynamic drag-reducing garment comprising aerodynamically efficient airfoil cross-section surfaces over the arms, legs, and/or torso. In one example, the surfaces are self-adaptive and body-conformable (aerodynamically efficient) airfoil cross-sections.

In a further example, the aerodynamically efficient airfoil cross-section surfaces of the front upper arm further comprise a bluff leading edge. In a further example, the aerodynamically efficient airfoil cross-section surfaces of the back lower arm and/or legs further comprise a cusp trailing edge.

In a further example, the drag-reducing garment conforms to the overall body shape and size when the body is at rest or in motion, in multiple postures.

In a further example, the airfoil shape of the leg and/or arm airfoils are adjustable by the wearer.

In a further example, the airfoil fairing surfaces are positioned and adapted to improve or increase aerodynamic efficiency around the shoulder joint and armpit.

In a further example, the airfoil fairing surfaces are positioned and adapted to improve aerodynamic efficiency around the legs.

In a further example, one or more of the airfoil cross-section surfaces are modular or separable or replaceable or interchangeable.

In a further example, a short-sleeve airfoil is removable. In a further example, a short-sleeve airfoil is interchangeable. In a further example, a long-sleeve airfoil is removable. In a further example, a long-sleeve airfoil is interchangeable.

In a further example, a long-sleeve airfoil is adjustable by the user. In a further example, the long-sleeve airfoil is adjustable by a wrist anchor adapted to adjust tension on the airfoil leading edge.

In a further example, a leg airfoil is removable. In a further example, a leg airfoil is interchangeable.

In a further example, a leg airfoil is adjustable by the user. In a further example, the leg airfoil is adjustable by an ankle anchor adapted to adjust tension on the airfoil trailing edge.

In a further example, portions of the drag-reducing garment are removable to enable user preference for one or more from the combination of: style, color, sizing, comfort, level of aerodynamic efficiency, airfoil adjustability, and/or non-adjustable airfoil.

In a further example, the airfoil surfaces of the aerodynamic drag-reducing garment self-adjust to arm and/or torso postures. In a further example, the airfoil surfaces of the drag-reducing garment self-adjust to the full range of leg motion. In a further example, the self-adjusting airfoil surfaces comprise a stretchable tensioned suspension line with a stretchable fabric draped over the suspension line.

In a further example, the airfoil surfaces of the drag-reducing garment are shaped to reduce drag by as much as 25%.

In a further example of the drag-reducing garment, the stretching strength of the airfoil surfaces to overcome is less than 10% of wearer's cycling exertion.

In one example, disclosed is a wearable airfoil comprising: a front portion of an outer surface of a wearable material, the wearable material conforming to a front portion of a human leg, forming a bluff leading edge; a back portion of the outer surface of the wearable material, the back portion diverging from a hind portion of the human leg; a third (upper) portion of the wearable material conforming to the hind portion of the human leg proximate to the upper portion of the adductor longus; a fourth (lower) portion of the wearable material conforming to the hind portion of the human leg, proximate to the lower soleus; an elastic line tethered between two anchor points, the first anchor point disposed on the third (upper) portion of an inner surface of the wearable material, and the second anchor point disposed on the fourth (lower) portion of the inner surface of the wearable material; wherein the back portion of the wearable material is stretched across and wrapping over the elastic line between the anchor points; wherein the elastic line forms a cusp shape, whereby a trailing edge is formed; and wherein the wearable material is attached to a pair of stretchable, body conforming shorts.

In one example, disclosed is a wearable airfoil comprising: a wearable material, wherein the wearable material conforms to a human leg at locations proximate to: the upper portion of the adductor longus; the lower portion of the soleus; and a front portion of the human leg, forming a bluff leading edge. An elastic line is tethered between two anchor points disposed on the material, the first anchor point disposed proximate to the upper portion of the adductor longus on a hind portion of the human leg, and the second anchor point disposed proximate to on the lower portion of the soleus on the hind portion of the human leg. Further, the wearable material stretches from the elastic line, diverging from the hind portion of the human leg between the two anchor points; the elastic line forms a cusp shape, whereby a trailing edge in the wearable material is formed; and the wearable material is attached to a pair of stretchable, body conforming shorts.

In a further example, the wearable material is detachable from the shorts.

In one example, disclosed is a wearable leg-conforming airfoil comprising: a front section conforming to the front leg, creating a bluff leading edge wrapping around the front of the leg; a back section joined to the front section along a single seam running along the sides of the leg and running around the back. Further, the back section is stretched across a tethered elastic line between two anchor points disposed on the back section with a first anchor point located proximate to the back of the ankle, and a second anchor point located proximate to the back of the leg (upper portion of the adductor longus). Further, the tethered elastic line forms a cusp shape, creating or otherwise forming a trailing edge; and the front and back sections are attached to a pair of stretchable body conforming shorts.

In a further example, the back section is detachable. In a further example, the front section is detachable. In a further example, the front and back sections are detachable from the shorts.

In one example, disclosed is a wearable arm airfoil comprising: a front bluff elastic band having ends connected at two anchors, with a first anchor located proximate to the wrist, and a second anchor located proximate to the shoulder; wherein the front bluff elastic band stretches along the radius bone and the humerus bone, between the two anchors; and a stretchable garment material, the garment material wrapping around the arm and over the band from wrist to shoulder; and a body conformable stretchable bodice. Further, the garment material is joined to the bodice by a flat elastic band disposed along the armsyce.

In one example, disclosed is a wearable shirt torso airfoil comprising: a cusped elastic line between two anchor points, the first anchor point on the sleeve, and the second anchor point on the torso; a stretchable garment wraps over the cusped elastic band between elbow and torso; conforming to chest on the front and to the back on the back; and herein elastic line creates a faring (suspension) from the elbow to the torso.

In a further example, the first anchor is near the elbow.

In a further example, the shirt is a short sleeve extending to the elbow.

In a further example, the shirt is a long sleeve extending to the wrist.

In one example, disclosed is a wearable arm and torso airfoil, comprising: the arm airfoil as previously described; the torso airfoil as previously described; wherein the arm airfoil is joined to the torso airfoil at a seam, the seam running along the humerus from proximately the shoulder to the elbow.

In a further example, the arm airfoil of the wearable arm and torso airfoil comprises: a front bluff elastic band having ends connected at two anchors, a first anchor located proximate to the wrist, and a second anchor located proximate to the shoulder; wherein the front bluff elastic band stretches along the radius bone and the humerus bone, between the two anchors; and a stretchable garment material, the garment material wrapping around the arm and over the band from wrist to shoulder; and a body conformable stretchable bodice; and wherein the garment material is joined to the bodice by a flat elastic band disposed along the armsyce.

In a further example, the torso airfoil of the wearable arm and torso airfoil comprises: a cusped elastic line between two anchor points, a first anchor point on the sleeve, a second anchor point on the torso; a stretchable garment wraps over the cusped elastic band between elbow and torso; and conforming to chest on the front and the back on the back; and wherein elastic line creates a faring (suspension) from the elbow to the torso.

In a further example, the shirt torso airfoil further comprises: a flat elastic band from the torso anchor; a waist anchor clasp; wherein the waist anchor clasp is attachable to a receiving clasp at the waist on a pair of pants.

In a further example, the waist anchor clasp of the shirt torso airfoil comprises a two-point engaging mechanism and a two-point dis-engaging mechanism.

In a further example, the two-point engaging mechanism actuates perpendicular to the two-point dis-engaging mechanism.

In a further example, the arm airfoil of the wearable arm and torso airfoil comprises: a front bluff elastic band having ends connected at two anchors, a first anchor located proximate to the wrist, and a second anchor located proximate to the shoulder; wherein the front bluff elastic band stretches along the radius bone and the humerus bone, between the two anchors; and a stretchable garment material, the garment material wrapping around the arm and over the band from wrist to shoulder; and a body conformable stretchable bodice; wherein the garment material is joined to the bodice by a flat elastic band disposed along the armsyce; and, in one example, wherein the wearable arm airfoil is long sleeve.

In a further example, the arm airfoil of the wearable arm and torso airfoil comprises: a front bluff elastic band having ends connected at two anchors, a first anchor located proximate to the wrist, and a second anchor located proximate to the shoulder; wherein the front bluff elastic band stretches along the radius bone and the humerus bone, between the two anchors; and a stretchable garment material, the garment material wrapping around the arm and over the band from wrist to shoulder; and a body conformable stretchable bodice; wherein the garment material is joined to the bodice by a flat elastic band disposed along the armsyce; and wherein the wearable arm airfoil is detachable from the bodice.

In a further example, the torso airfoil of the wearable arm and torso airfoil comprises: a cusped elastic line between two anchor points, a first anchor point on the sleeve, and a second anchor point on the torso; and a stretchable garment wraps over the cusped elastic band between elbow and torso; conforming to chest on the front and back on the back; wherein elastic line creates a faring (suspension) from the elbow to the torso; and wherein the wearable shirt torso airfoil is detachable from the bodice. In a further example, the wearable arm and torso airfoils are detachable from the bodice. In a further example, the wearable arm and torso airfoils are detachable from the bodice along the flat elastic band disposed along the armscye.

CONCLUSION

Although the present invention is described herein with reference to a specific preferred embodiment(s), many modifications and variations therein will readily occur to those with ordinary skill in the art. Accordingly, all such variations and modifications are included within the intended scope of the present invention as defined by the reference numerals used.

From the description contained herein, the features of any of the examples, especially as set forth in the claims, can be combined with each other in any meaningful manner to form further examples and/or embodiments.

The foregoing description is presented for purposes of illustration and description, and is not intended to limit the invention to the forms and methods disclosed herein. Consequently, variations and modifications commensurate with the above teachings and the teaching of the relevant art are within the spirit of the invention. Such variations will readily suggest themselves to those skilled in the relevant structural or mechanical art. Further, the embodiments described are also intended to enable others skilled in the art to utilize the invention and such or other embodiments and with various modifications required by the particular applications or uses of the invention.

What is claimed is:

1. An airfoil garment, having a chest portion and a back portion forming a bodice and a sleeve portion, comprising:

a wearable garment;

a torso airfoil comprising:

a cusped elastic line between two anchor points, the first anchor point on the sleeve, and the second anchor point at the nadir of an arm opening of the bodice;

the airfoil garment having a stretchable portion that wraps over the cusped elastic line, adapted to wrap between elbow and torso; conforming to the chest portion of the shirt on the front and conforming to the back portion of the shirt on the back; and wherein the elastic line is configured to create a faring from the elbow to the torso; and a leg airfoil comprising:

a front section adapted to conform to a front of a leg, creating a bluff leading edge adapted to wrap around the front of the leg; and a back section joined to the front section along a single seam adapted to run along the sides of the leg and adapted to run around the back; and wherein the back section is stretched across a tethered elastic line between two anchor points disposed on the back section with a first anchor point adapted to be located proximate to an upper portion of the adductor longus of the back of the leg, and a second anchor point adapted to be located proximate to the back of an ankle of the leg.

2. The airfoil garment of claim 1 comprising a wearable arm airfoil, wherein the wearable arm airfoil comprises:

a front bluff elastic band having ends connected at two anchors, with a third anchor adapted to be located proximate to a wrist, and a fourth anchor adapted to be located proximate to a front portion of the shoulder;

wherein the front bluff elastic band is adapted to stretch along a radius bone and a humerus bone, between the third and fourth anchors; and a stretchable garment material, the garment material adapted to wrap around the arm and over the band from wrist to the front portion of the shoulder.

* * * * *